US010229644B2

(12) United States Patent
Noichi

(10) Patent No.: US 10,229,644 B2
(45) Date of Patent: Mar. 12, 2019

(54) DISPLAY DEVICE, CONTROL METHOD, AND SEMICONDUCTOR DEVICE

(71) Applicant: Japan Display Inc., Tokyo (JP)

(72) Inventor: Shunsuke Noichi, Tokyo (JP)

(73) Assignee: Japan Display Inc., Tokyo (JP)

( * ) Notice: Subject to any disclaimer, the term of this patent is extended or adjusted under 35 U.S.C. 154(b) by 178 days.

(21) Appl. No.: 15/466,061

(22) Filed: Mar. 22, 2017

(65) Prior Publication Data

US 2017/0287419 A1 Oct. 5, 2017

(30) Foreign Application Priority Data

Mar. 30, 2016 (JP) ..... 2016-069367

(51) Int. Cl.
*G09G 3/36* (2006.01)

(52) U.S. Cl.
CPC ..... *G09G 3/3614* (2013.01); *G09G 3/3677* (2013.01); *G09G 2310/0243* (2013.01); *G09G 2320/0247* (2013.01); *G09G 2330/023* (2013.01)

(58) Field of Classification Search
CPC ..... G09G 3/36; G09G 3/3614; G09G 3/3677; G09G 2330/023; G09G 2320/0247; G09G 2310/0243
See application file for complete search history.

(56) References Cited

U.S. PATENT DOCUMENTS

2002/0080102 A1* 6/2002 Asao ..... G09G 3/3648 345/87
2005/0001808 A1* 1/2005 Lee ..... G09G 3/3655 345/96
2010/0156928 A1* 6/2010 Lee ..... G09G 3/2096 345/589
2016/0293125 A1* 10/2016 Huang ..... G09G 3/3614

FOREIGN PATENT DOCUMENTS

JP 05-043118 B2 6/1993

* cited by examiner

*Primary Examiner* — Carolyn R Edwards
(74) *Attorney, Agent, or Firm* — Michael Best & Friedrich LLP

(57) ABSTRACT

According to an aspect, a display device includes an image display panel and a driver driving the image display panel. The driver implements a first display mode in which a common voltage is a constant DC voltage; polarity of the video signal is inverted per a predetermined number of video signal lines; and the polarity of the video signal per a predetermined number of video signal lines is inverted in a frame unit, and a second display mode in which the common voltage is an AC voltage, polarity of which is inverted in a frame unit; the polarity of the video signal is opposite to the polarity of the common voltage; and the polarity of the video signal is inverted to be opposite to the polarity of the common voltage in a frame unit, and switches between these modes according to a mode switching signal from the outside.

12 Claims, 26 Drawing Sheets

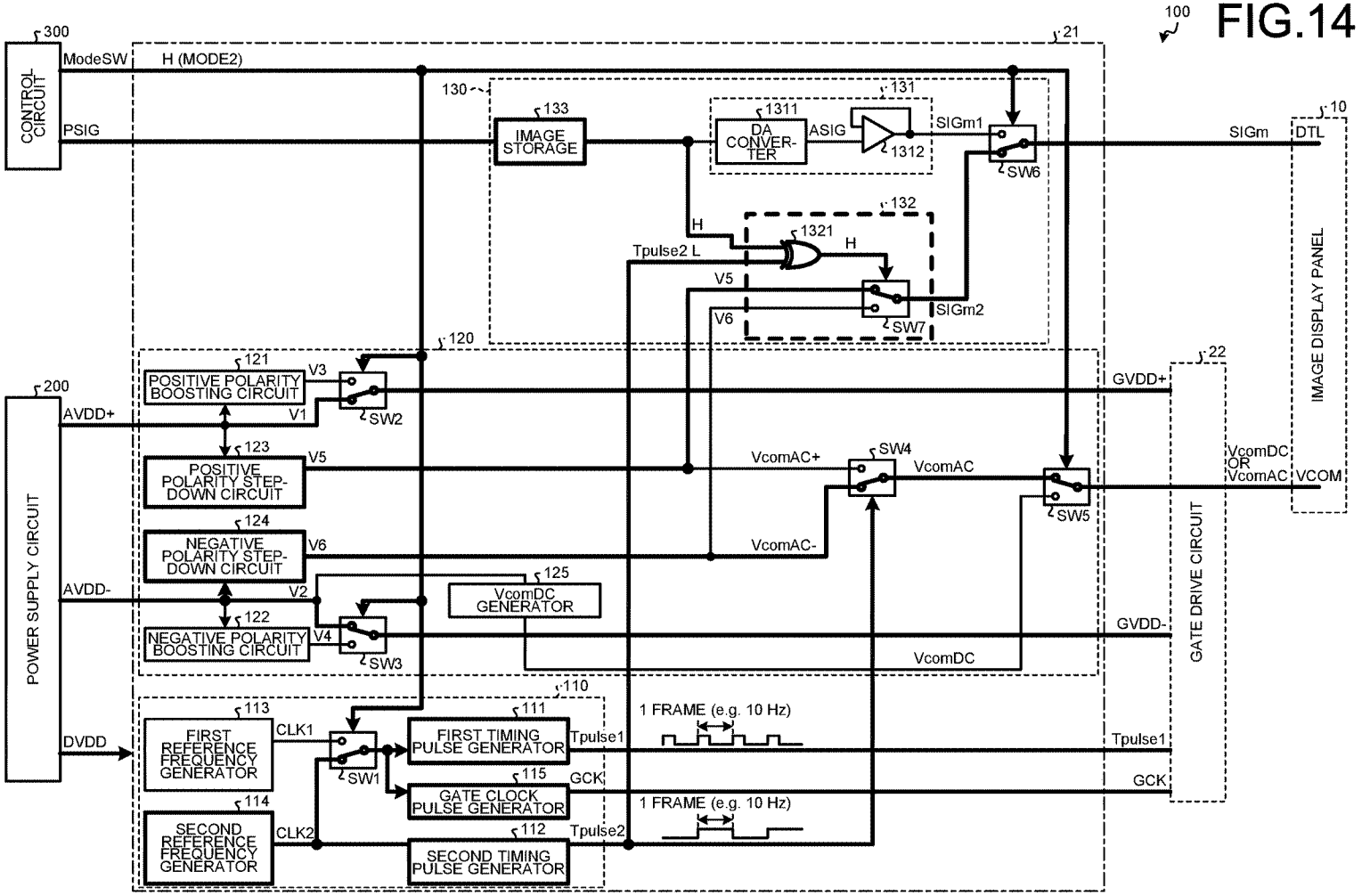
FIG.14
100
10
IMAGE DISPLAY PANEL
DTL
SIGm
VcomDC OR VcomAC
VCOM
22
GATE DRIVE CIRCUIT
GVDD+
GVDD-
Tpulse1
GCK
21
SW6
SW5
SIGm1
SIGm2
131
1312
132
SW7
SW4
VcomAC
VcomDC
ASIG
1311
DA CONVERTER
1321
H
VcomAC+
VcomAC-
V5
V6
Tpulse2 L
1 FRAME (e.g. 10 Hz)
Tpulse2
133
IMAGE STORAGE
125
VcomDC GENERATOR
110
111
FIRST TIMING PULSE GENERATOR
115
GATE CLOCK PULSE GENERATOR
112
SECOND TIMING PULSE GENERATOR
130
120
SW2
SW3
SW1
V3
V1
V4
V2
121
POSITIVE POLARITY BOOSTING CIRCUIT
123
POSITIVE POLARITY STEP-DOWN CIRCUIT
124
NEGATIVE POLARITY STEP-DOWN CIRCUIT
122
NEGATIVE POLARITY BOOSTING CIRCUIT
CLK1
CLK2
113
FIRST REFERENCE FREQUENCY GENERATOR
114
SECOND REFERENCE FREQUENCY GENERATOR
H (MODE2)
ModeSW
PSIG
300
CONTROL CIRCUIT
AVDD+
AVDD-
DVDD
200
POWER SUPPLY CIRCUIT

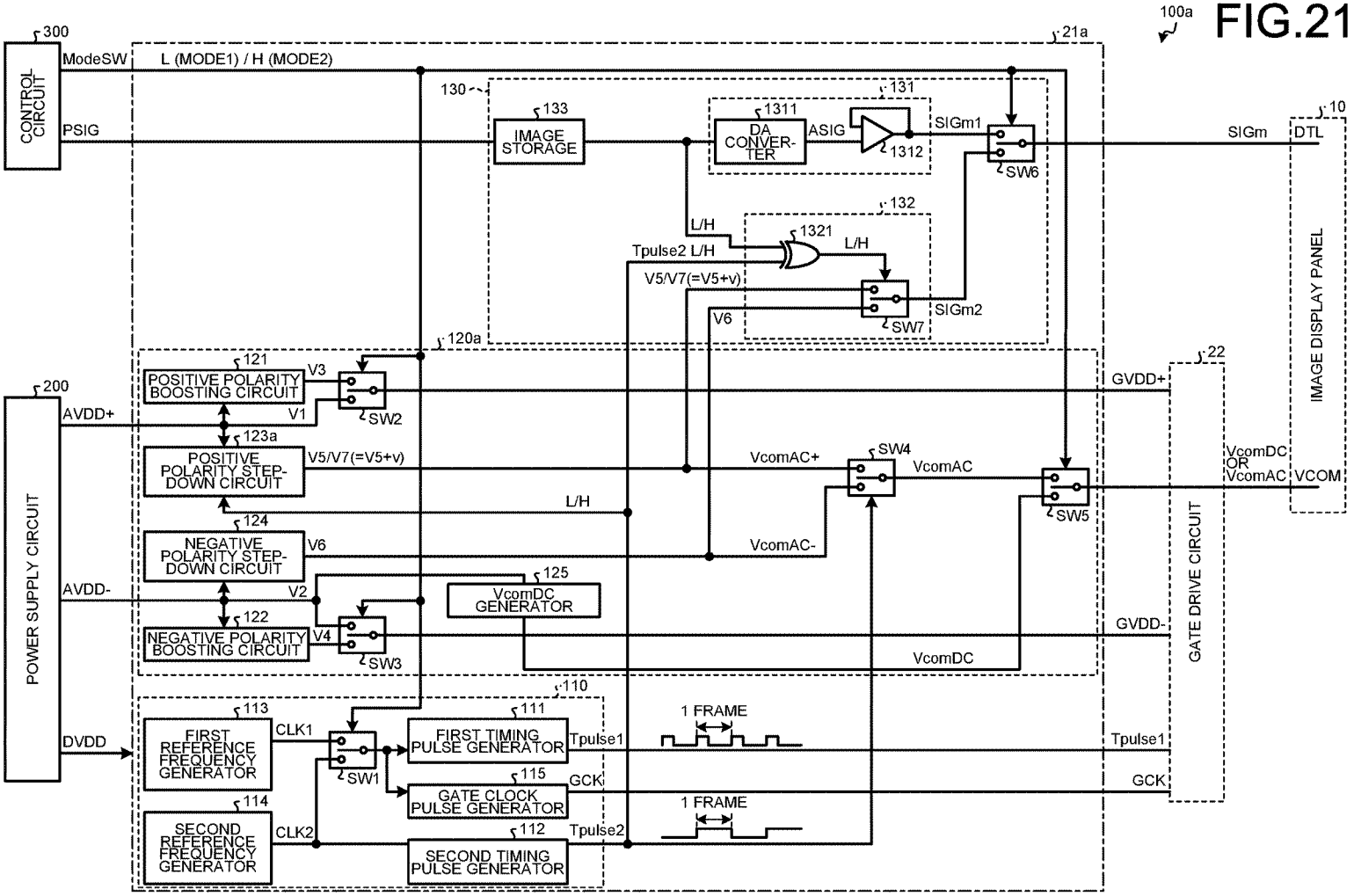
FIG.21
100a
10
IMAGE DISPLAY PANEL
DTL
SIGm
VcomDC OR VcomAC
VCOM
22
GATE DRIVE CIRCUIT
GVDD+
GVDD-
Tpulse1
GCK
21a
SW5
SW6
SIGm1
SIGm2
SW7
131
1312
132
L/H
1321
ASIG
1311
DA CONVERTER
VcomAC
SW4
VcomDC
VcomAC+
VcomAC-
V6
L/H
Tpulse2
V5/V7(=V5+v)
1 FRAME
1 FRAME
133
IMAGE STORAGE
130
120a
125
VcomDC GENERATOR
110
111
FIRST TIMING PULSE GENERATOR
115
GATE CLOCK PULSE GENERATOR
112
SECOND TIMING PULSE GENERATOR
Tpulse1
GCK
Tpulse2
SW2
SW3
SW1
V3
V1
V5/V7(=V5+v)
V6
V2
V4
121
POSITIVE POLARITY BOOSTING CIRCUIT
123a
POSITIVE POLARITY STEP-DOWN CIRCUIT
124
NEGATIVE POLARITY STEP-DOWN CIRCUIT
122
NEGATIVE POLARITY BOOSTING CIRCUIT
113
FIRST REFERENCE FREQUENCY GENERATOR
114
SECOND REFERENCE FREQUENCY GENERATOR
CLK1
CLK2
L (MODE1) / H (MODE2)
ModeSW
PSIG
300
CONTROL CIRCUIT
AVDD+
AVDD-
DVDD
200
POWER SUPPLY CIRCUIT

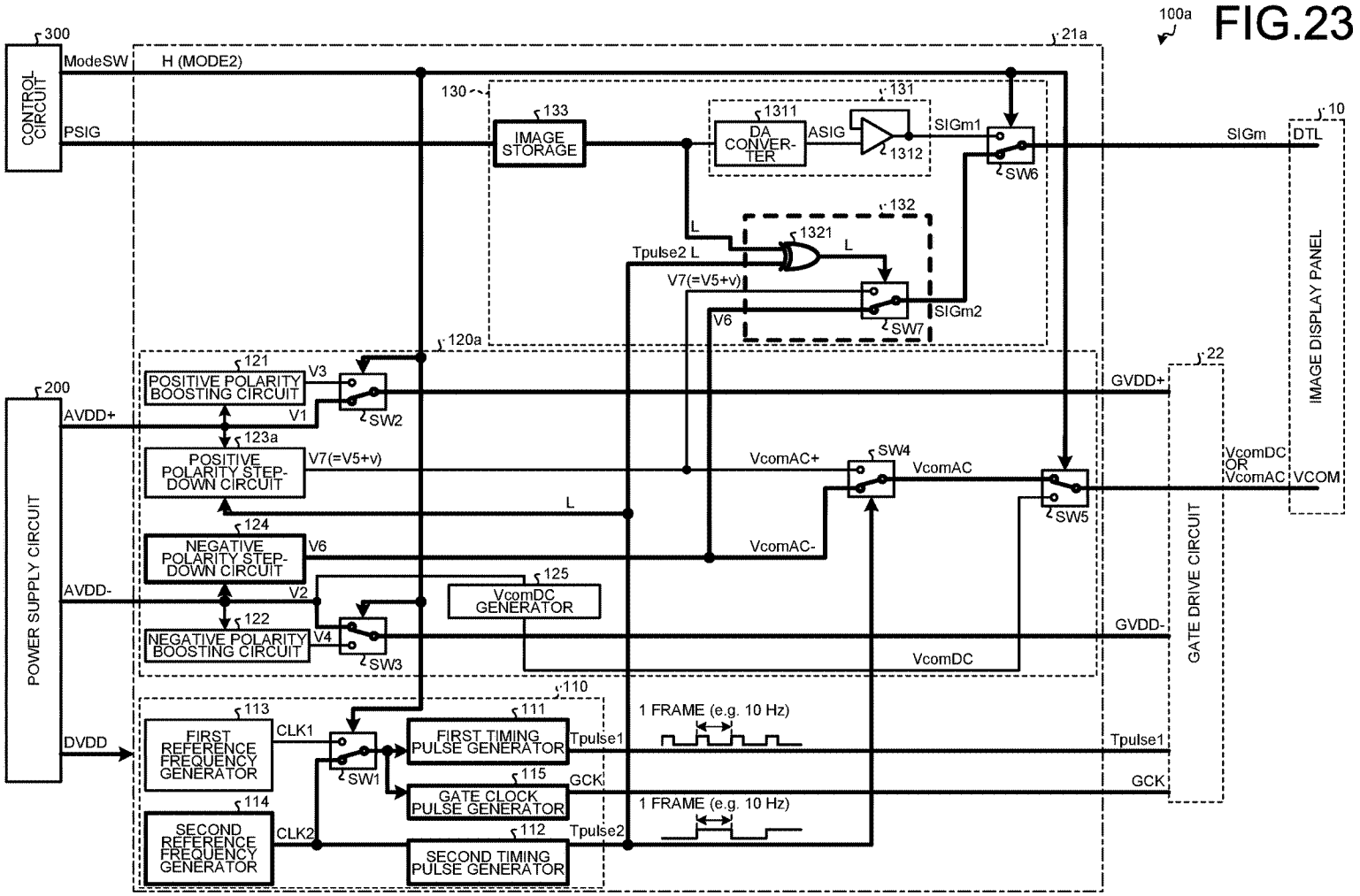
FIG.23
100a
10
IMAGE DISPLAY PANEL
DTL
SIGm
VcomDC OR VcomAC
VCOM
22
GATE DRIVE CIRCUIT
GVDD+
GVDD-
Tpulse1
GCK
21a
SW6
SW5
SIGm1
SIGm2
131
1312
132
SW7
SW4
VcomAC
VcomDC
ASIG
1311
DA CONVERTER
1321
L
VcomAC+
VcomAC-
V7(=V5+v)
V6
Tpulse2 L
1 FRAME (e.g. 10 Hz)
1 FRAME (e.g. 10 Hz)
133
IMAGE STORAGE
130
125
VcomDC GENERATOR
110
Tpulse1
GCK
Tpulse2
111
FIRST TIMING PULSE GENERATOR
115
GATE CLOCK PULSE GENERATOR
112
SECOND TIMING PULSE GENERATOR
120a
SW2
SW3
SW1
V3
V1
V7(=V5+v)
V6
V2
V4
CLK1
CLK2
121
POSITIVE POLARITY BOOSTING CIRCUIT
123a
POSITIVE POLARITY STEP-DOWN CIRCUIT
124
NEGATIVE POLARITY STEP-DOWN CIRCUIT
122
NEGATIVE POLARITY BOOSTING CIRCUIT
113
FIRST REFERENCE FREQUENCY GENERATOR
114
SECOND REFERENCE FREQUENCY GENERATOR
H (MODE2)
ModeSW
PSIG
AVDD+
AVDD-
DVDD
300
CONTROL CIRCUIT
200
POWER SUPPLY CIRCUIT

DISPLAY DEVICE, CONTROL METHOD, AND SEMICONDUCTOR DEVICE

CROSS-REFERENCE TO RELATED APPLICATIONS

This application claims priority from Japanese Application No. 2016-069367, filed on Mar. 30, 2016, the contents of which are incorporated by reference herein in its entirety.

BACKGROUND

1. Technical Field

The present invention relates to a display device, a control method, and a semiconductor device.

2. Description of the Related Art

As a display device, there is an active matrix type liquid crystal display device including an amorphous silicon (a-Si) thin film transistor (TFT) or a low-temperature polysilicon (LTPS) TFT as a transistor constituting a pixel transistor or an RGB changeover switch. In such a liquid crystal display device, a display region for displaying an image is configured such that pixels each including a pixel capacitor and a TFT are arranged in a matrix therein, a drain of the TFT being coupled to one end of the pixel capacitor. In a pixel transistor in which a gate bus line (scanning signal line) and a source bus line (video signal line) are arranged in a grid-like fashion to constitute each pixel, a gate electrode is coupled to the gate bus line, and a source electrode is coupled to the source bus line. A common electrode that applies a common voltage to each pixel is coupled to the other end of the pixel capacitor. In such a configuration, a gate voltage different from the common voltage is applied from the gate bus line coupled to the gate electrode of each pixel transistor, and in a state in which a potential difference is generated between the gate electrode and the common electrode, a voltage (hereinafter, also referred to as a "pixel voltage") corresponding to a video signal supplied from the source bus line coupled to the source electrode is applied to the pixel capacitor. Accordingly, an image is displayed in the display region.

As a driving method for a liquid crystal display device, an inversion driving method of inverting polarity of the pixel voltage in a frame unit is generally used to prevent deterioration of liquid crystals. However, when pixel voltages of all pixels in the display region are uniformly inverted in a frame unit, luminance is changed in a frame unit in displaying the image, and flicker is easily generated. Thus, as the inversion driving method, for example, it is known that there is a technique for preventing flicker from being generated by employing a column inversion driving method of inverting polarity of a video signal per a predetermined number of source bus lines and inverting the polarity of the video signal per a predetermined number of source bus lines in a frame unit, or a dot inversion driving method of inverting the polarity of the video signal between adjacent pixel groups for each pixel group constituting one dot and inverting the polarity of the video signal for each pixel group in a frame unit similarly to the column inversion driving method.

For the liquid crystal display device, power consumption is required to be reduced to decrease a battery capacity in accordance with downsized terminal equipment and to extend a battery duration time. Typically, in the inversion driving method, when a polarity inversion pattern is complicated, flicker is hardly generated, but power consumption is increased. For example, Japanese Examined Patent Application Publication No. 5-43118 discloses that charge and discharge in the signal line are smaller and that power consumption is reduced in the column inversion driving method as compared with the dot inversion driving method.

In recent years, liquid crystal display devices are required to display a static image and a moving image with high display quality in addition to the reduction in power consumption described above. However, with a conventional method, a power supply voltage needs to be boosted to be supplied to a gate drive circuit to secure image display with high display quality.

For the foregoing reasons, there is a need for a display device, a control method, and a semiconductor device that can perform image display with high display quality and can further reduce power consumption at the same time.

SUMMARY

According to an aspect, a display device includes: an image display panel including: a plurality of pixels; a plurality of scanning lines, each of which is coupled to the pixels arranged in a first direction, and to which a scanning signal is supplied; a plurality of video signal lines, each of which is coupled to the pixels arranged in a second direction intersecting the first direction, and to which a video signal is supplied; and a common electrode that is coupled to the pixels, and to which a common voltage is applied; and a driver configured to drive the image display panel. The driver is configured to implement a first display mode in which the common voltage is a constant DC voltage; polarity of the video signal is inverted per a predetermined number of the video signal lines; and the polarity of the video signal per a predetermined number of the video signal lines is inverted in a frame unit, and a second display mode in which the common voltage is an AC voltage, polarity of which is inverted in a frame unit; the polarity of the video signal is opposite to the polarity of the common voltage; and the polarity of the video signal is inverted to be opposite to the polarity of the common voltage in a frame unit, and the driver is configured to switch between the first display mode and the second display mode in accordance with a mode switching signal supplied from the outside.

According to another aspect, a control method for controlling an image display panel, the image display panel including: a plurality of pixels; a plurality of scanning lines, each of which is coupled to the pixels arranged in a first direction, and to which a scanning signal is supplied; a plurality of video signal lines, each of which is coupled to the pixels arranged in a second direction intersecting the first direction, and to which a video signal is supplied; and a common electrode that is coupled to the pixels, and to which a common voltage is applied, the control method includes: implementing a first display mode and a second display mode each having a different driving method for driving the image display panel; in the first display mode, causing the common voltage to be a constant DC voltage, inverting polarity of the video signal per a predetermined number of the video signal lines, and inverting the polarity of the video signal per a predetermined number of the video signal lines in a frame unit; in the second display mode, causing the common voltage to be an AC voltage, polarity of which is inverted in a frame unit, making the polarity of the video signal opposite to the polarity of the common voltage, and inverting the polarity of the video signal to be opposite to the polarity of the common voltage in a frame unit; switching the second display mode to the first display mode in accordance with a first switching signal supplied from the outside; and switching the first display mode to the second display mode in accordance with a second switching signal supplied from the outside.

According to another aspect, a semiconductor device for driving an image display panel, the image display panel includes: a plurality of pixels; a plurality of scanning lines, each of which is coupled to the pixels arranged in a first direction, and to which a scanning signal is supplied; a plurality of video signal lines, each of which is coupled to the pixels arranged in a second direction intersecting the first direction, and to which a video signal is supplied; and a common electrode that is coupled to the pixels, and to which a common voltage is applied. The semiconductor device implements a first display mode in which the common voltage is a constant DC voltage; polarity of the video signal is inverted per a predetermined number of the video signal lines; and the polarity of the video signal per a predetermined number of the video signal lines is inverted in a frame unit, and a second display mode in which the common voltage is an AC voltage, polarity of which is inverted in a frame unit; the polarity of the video signal is opposite to the polarity of the common voltage; and the polarity of the video signal is inverted to be opposite to the polarity of the common voltage in a frame unit, and the first display mode and the second display mode can be switched in accordance with a mode switching signal from the outside.

BRIEF DESCRIPTION OF THE DRAWINGS

FIG. 14 is a diagram illustrating a third operation example in the second display mode according to the first embodiment;

FIG. 21 is a diagram illustrating an example of an internal block configuration of a signal output circuit of a display device according to the second embodiment;

FIG. 23 is a diagram illustrating a first operation example in a second display mode according to the second embodiment;

DETAILED DESCRIPTION

Figure 1:
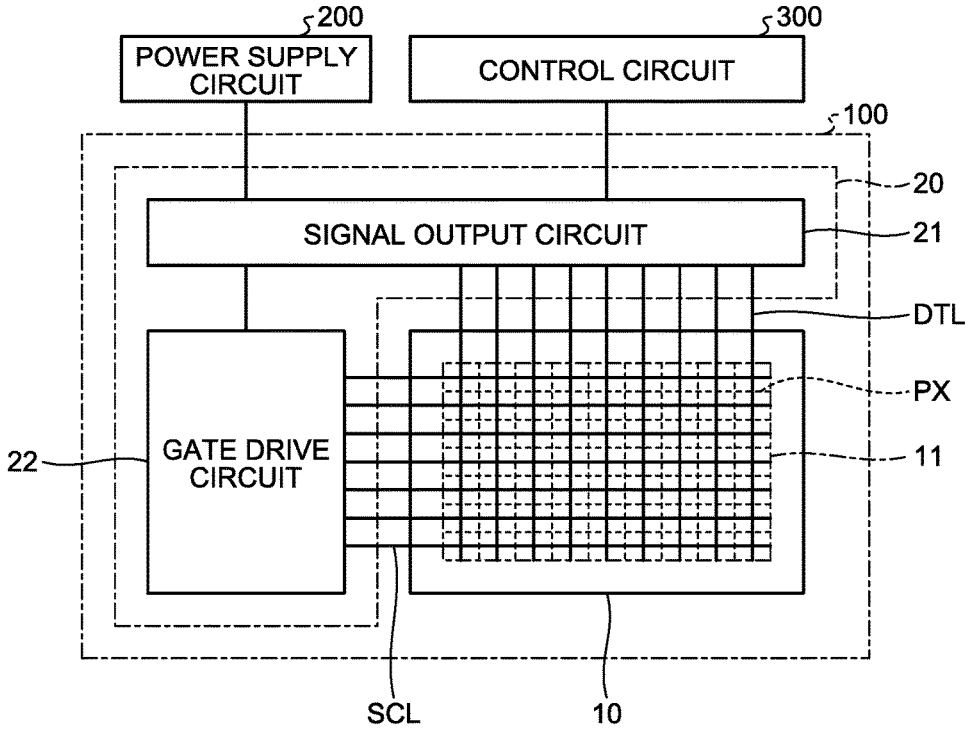
FIG. 1 is a block diagram illustrating an example of a schematic configuration of a display system to which a display device according to a first embodiment of the present invention is applied.

The following describes a mode for carrying out the invention (embodiments) in detail with reference to the drawings. The present invention is not limited to the embodiments described below. Components described below include a component that is easily conceivable by those skilled in the art and components that are substantially the same. The components described below can be appropriately combined. The disclosure is merely an example, and the present invention naturally encompasses an appropriate modification maintaining the gist of the invention that is easily conceivable by those skilled in the art. To further clarify the description, the width, the thickness, the shape, and the like of each component may be schematically illustrated in the drawings as compared with an actual aspect. However, the drawings merely provide examples, and are not intended to limit interpretation of the invention. The same element as that described in the drawing already discussed is denoted by the same reference numeral throughout the description and the drawings, and detailed description thereof will not be repeated in some cases.

First Embodiment

Figure 2:
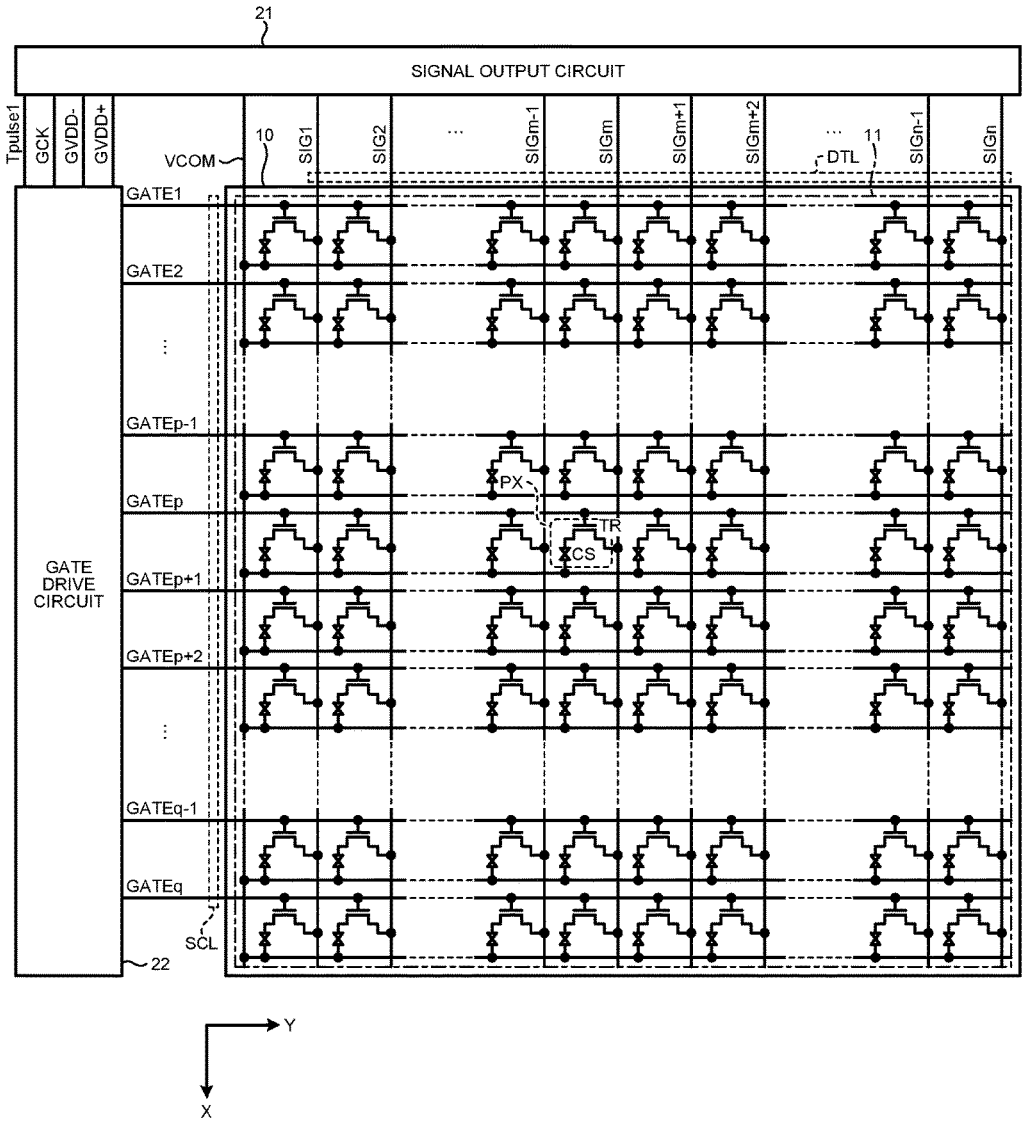
FIG. 2 is a diagram illustrating a configuration example of the display device according to the first embodiment.

FIG. 1 is a block diagram illustrating an example of a schematic configuration of a display system to which a display device according to a first embodiment of the present invention is applied. FIG. 2 is a diagram illustrating a configuration example of the display device according to the first embodiment.

A display device 100 according to the first embodiment receives, for example, various power supply voltages applied from a power supply circuit 200 of an electronic apparatus on which the display device 100 is mounted, and performs image display based on an output signal output from a control circuit 300 serving as a host processor of the electronic apparatus, for example. Examples of the electronic apparatus on which the display device 100 is mounted include, but are not limited to, information terminal equipment such as a smartphone.

In the example illustrated in FIG. 1, the display device 100 is, for example, a transmissive or reflective liquid crystal display device, and includes an image display panel 10 serving as a color liquid crystal display panel and an image display panel driver 20.

The power supply circuit 200 is a power supply generator that generates a power supply voltage to be applied to each component of the display device 100 according to the present embodiment. The power supply circuit 200 is coupled to the image display panel driver 20.

The control circuit 300 is an arithmetic processor that controls an operation of the display device 100 according to the present embodiment. The control circuit 300 is coupled to the image display panel driver 20.

In the image display panel 10, a display region 11 includes a plurality of pixels PX arranged in a matrix. In the image display panel 10 in the example illustrated in FIG. 2, n×q (n in a row direction, and q in a column direction) pixels PX each including a pixel transistor (for example, a thin film transistor (TFT)) TR and a pixel capacitor CS are arranged in a two-dimensional matrix. FIG. 2 illustrates an example in which the pixels PX are arranged in a matrix on an XY two-dimensional coordinate system. In this example, the row direction is the X-direction, and the column direction is the Y-direction. Hereinafter, the pixels PX arranged in the X-direction (row direction) are referred to as a "pixel row", and the pixels PX arranged in the Y-direction (column direction) are referred to as a "pixel column". The pixel PX corresponds to a pixel electrode in the present disclosure. The row direction corresponds to a first direction, and the column direction corresponds to a second direction, in the present disclosure.

The image display panel driver 20 includes a signal output circuit 21 and a gate drive circuit 22.

In the image display panel driver 20, the signal output circuit 21 holds video signals to be sequentially output to the image display panel 10. The signal output circuit 21 is electrically coupled to the image display panel 10 via a source bus line (video signal line) DTL, and transmits source signals (video signals) SIG1 to SIGn for each pixel column. Each of the source signals (video signals) SIG1 to SIGn is supplied to a source of the pixel transistor TR of each pixel PX in each pixel column.

The image display panel driver 20 selects the pixel PX in the image display panel 10 using the gate drive circuit 22 including a shift register, for example, and performs control to turn ON and OFF the pixel transistor TR of each pixel PX. The gate drive circuit 22 is electrically coupled to the image display panel 10 via a gate bus line (scanning line) SCL, and transmits gate signals (scanning signals) GATE1 to GATEq for each pixel row. Each of the gate signals (scanning signals) GATE1 to GATEq is supplied to a gate of the pixel transistor TR of each pixel PX in each pixel row.

The signal output circuit 21 supplies a common voltage to the pixel capacitor CS of each pixel PX via a common electrode VCOM, and supplies, to the gate drive circuit 22, a gate positive voltage GVDD+, a gate negative voltage GVDD−, a first timing pulse Tpulse1, and a gate clock pulse GCK. The gate positive voltage GVDD+ gives a high potential side voltage of the gate signals (scanning signals) GATE1 to GATEq. The gate negative voltage GVDD− gives a low potential side voltage of the gate signals (scanning signals) GATE1 to GATEq. The first timing pulse Tpulse1 is for controlling output start timing of each of the gate signals (scanning signals) GATE1 to GATEq for each frame. The gate clock pulse GCK is for controlling output timing of each of the gate signals GATE1 to GATEq.

A plurality of adjacent pixels PX constitute one dot. One dot may be configured such that, for example, three primary colors (for example, red, green, and blue) are displayed with three pixels PX arranged in the row direction. The direction in which the pixels PX constituting one dot are arranged is not limited to the row direction, and may be the column direction or a plurality of directions. The colors constituting one dot are not limited to the primary colors, and the number of colors constituting one dot is not limited to three. For example, four colors including white in addition to the three primary colors may be displayed with four pixels PX, or only white may be associated with the dot for white and black display. The pixel configuration included in one dot does not limit the present invention.

FIGS. 1 and 2 exemplify a configuration in which the source bus line (video signal line) DTL is coupled for each pixel column and the source signals (video signals) SIG1 to SIGn are transmitted for each pixel column. Alternatively, video signals corresponding to three primary colors or four colors constituting one dot may be transmitted in a time division manner via one signal line DTL, and each color may be selected using a color changeover switch. As an example of using such a color changeover switch, a configuration using a low-temperature polysilicon (LTPS) TFT as a switching element such as the pixel transistor TR on the image display panel 10 can be employed. The present embodiment is not limited to the configuration using the low-temperature polysilicon (LTPS) TFT. For example, an amorphous silicon (a-Si) TFT may be used. In the following description, as illustrated in FIG. 2, a configuration without the color conversion switch is used.

In the present embodiment, the display device 100 configured as described above includes a first display mode in which multicolor display is performed at a high frame rate, and a second display mode in which display is performed by limiting the number of colors to be displayed as compared with the first display mode at a frame rate lower than that of the first display mode. The two display modes can be dynamically switched.

More specifically, the image display panel 10 is driven by using the column inversion driving method in the first display mode, and the image display panel 10 is driven by using the frame inversion driving method in the second display mode.

Figure 3A:
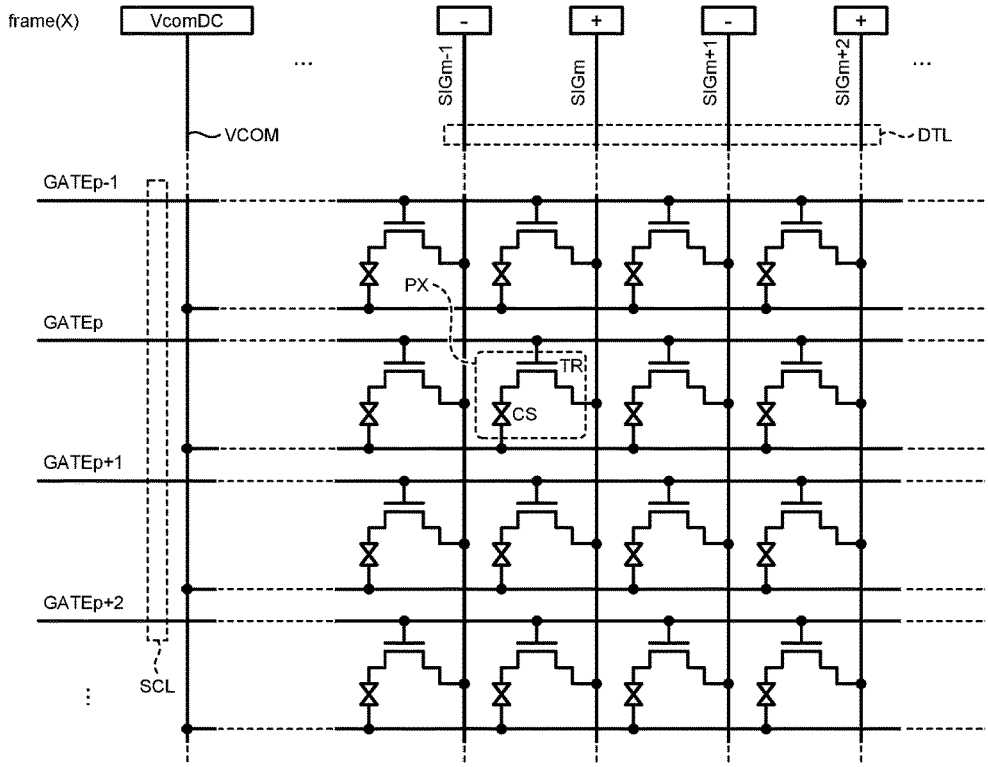
FIGS. 3A and 3B are diagrams each illustrating a driving example of a common electrode and a video signal line in a column inversion driving method.
Figure 3B:
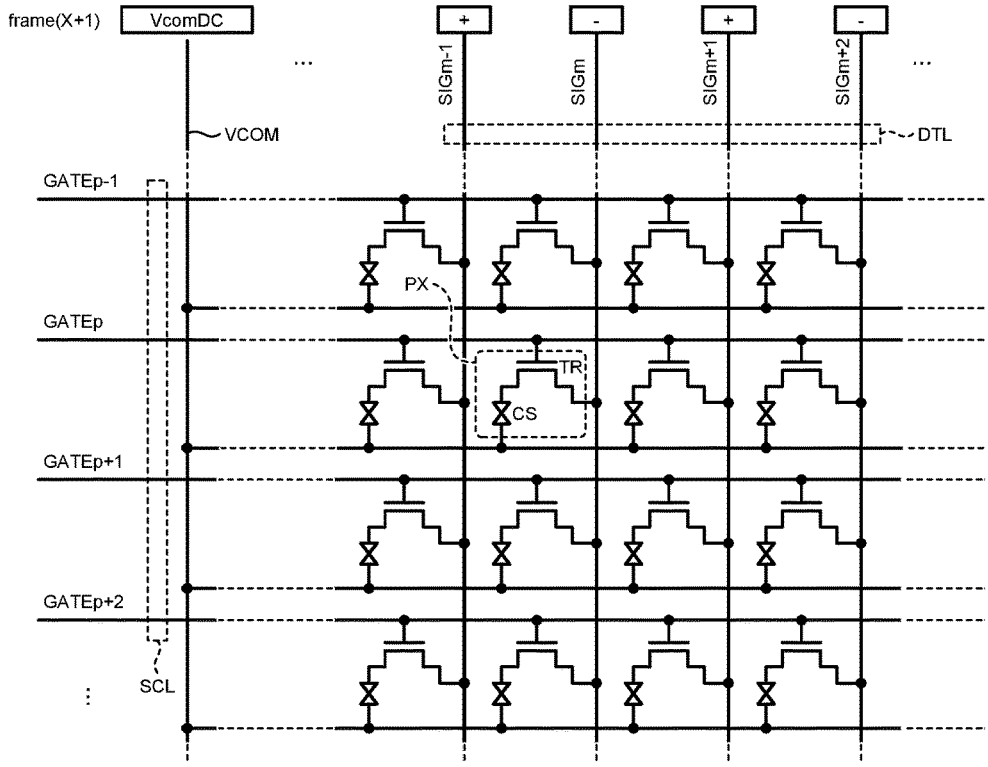
Figure 4:
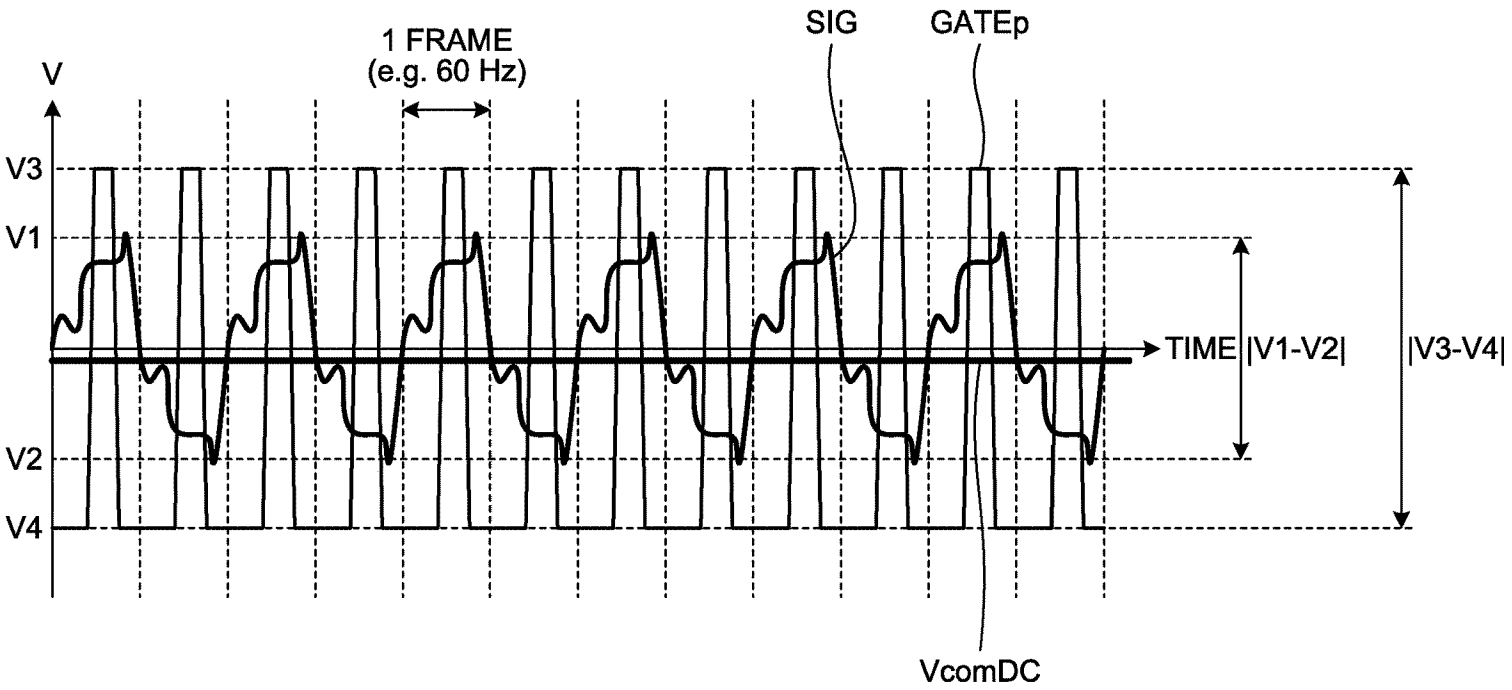
FIG. 4 is a diagram illustrating a waveform example of the column inversion driving method.

FIGS. 3A and 3B are diagrams each illustrating a driving example of the common electrode and the video signal line in the column inversion driving method. FIG. 4 is a diagram illustrating a waveform example of the column inversion driving method. FIG. 4 illustrates a waveform example in each component of a DC common voltage VcomDC, a video signal SIG inverted in a frame unit, and a gate signal GATEp in the pixel PX in the m-th column and the p-th row.

In the column inversion driving method, the DC common voltage VcomDC as a constant DC voltage is applied to the common electrode VCOM, polarity of the source signals (video signals) SIG1 to SIGn is inverted per a predetermined number of source bus lines (video signal lines) DTL, and the polarity of the video signals SIG1 to SIGn is inverted in a frame unit per a predetermined number of source bus lines (video signal lines) DTL.

In the example illustrated in FIGS. 3A and 3B, the voltage applied to the common electrode VCOM is a constant DC common voltage VcomDC. In a frame (X) (FIG. 3A), each of source signals (video signal) SIGm−1 and SIGm+1 is a signal of negative polarity (−), and each of source signals (video signals) SIGm and SIGm+2 is a signal of positive polarity (+). In the next frame (X+1) (FIG. 3B), the polarity of each source bus line (video signal line) DTL is inverted with respect to the frame (X) (FIG. 3A), so that each of the source signals (video signals) SIGm−1 and SIGm+1 is the signal of positive polarity (+), and each of the source signals (video signals) SIGm and SIGm+2 is the signal of negative polarity (−). By repeating the processing illustrated in FIGS. 3A and 3B, the waveform of each part illustrated in FIG. 4 can be obtained.

In the column inversion driving method, as illustrated in FIG. 4, the polarity of the video signal SIG is inverted in a frame unit, so that each of the source signals (video signals) SIG1 to SIGn (in this case, SIGm) of |V1−V2| [V] (for example, −5 [V] to +5 [V]) at a maximum is input to each source bus line (video signal line) DTL. To reproduce the video signal SIG of |V1−V2| [V] (for example, −5 [V] to +5 [V]), a peak value of the gate signals (scanning signals) GATE1 to GATEq (in the example illustrated in FIG. 4, GATEp) given to each gate bus line (scanning line) SCL needs to be |V3−V4| [V] (for example, about −7 [V] to +8 [V]), which is larger than |V1−V2| [V]. That is, a gate ON voltage V3 [V] (for example, +8 [V]) that is sufficiently higher than a maximum voltage V1 [V] (for example, +5 [V]) of the video signal SIG applied to the source bus line (video signal line) DTL needs to be supplied as the gate positive voltage GVDD+ that gives a high potential side voltage of each of the gate signals (scanning signals) GATE1 to GATEq, and a gate OFF voltage V4 [V] (for example, −7 [V]) that is sufficiently lower than a minimum voltage V2 [V] (for example, −5 [V]) of the video signal SIG applied to the source bus line (video signal line) DTL needs to be supplied as the gate negative voltage GVDD− that gives a low potential side voltage of each of the gate signals (scanning signals) GATE1 to GATEq.

Figure 5A:
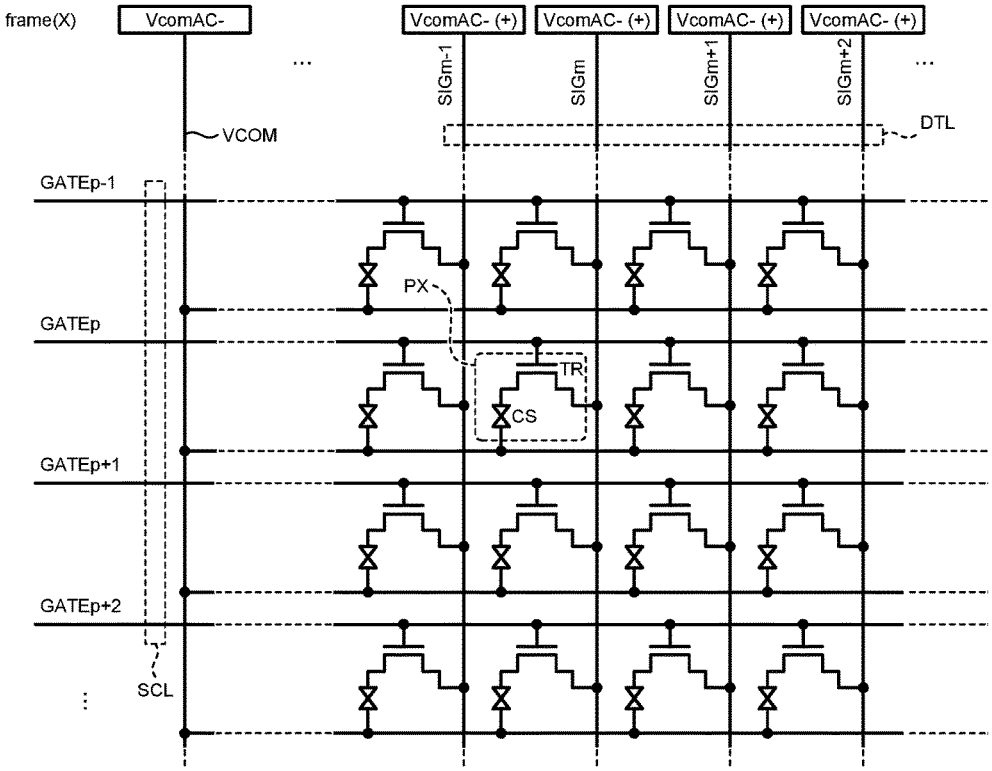
FIGS. 5A and 5B are diagrams each illustrating a driving example of the common electrode and the video signal line in a frame inversion driving method.
Figure 5B:
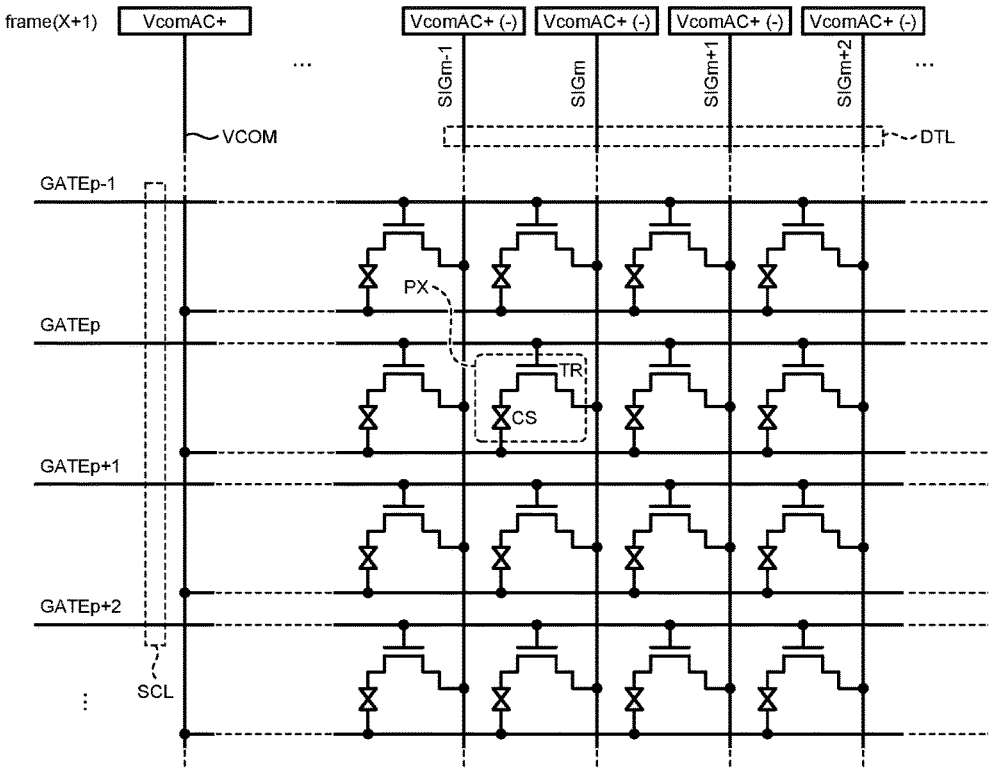
Figure 6A:
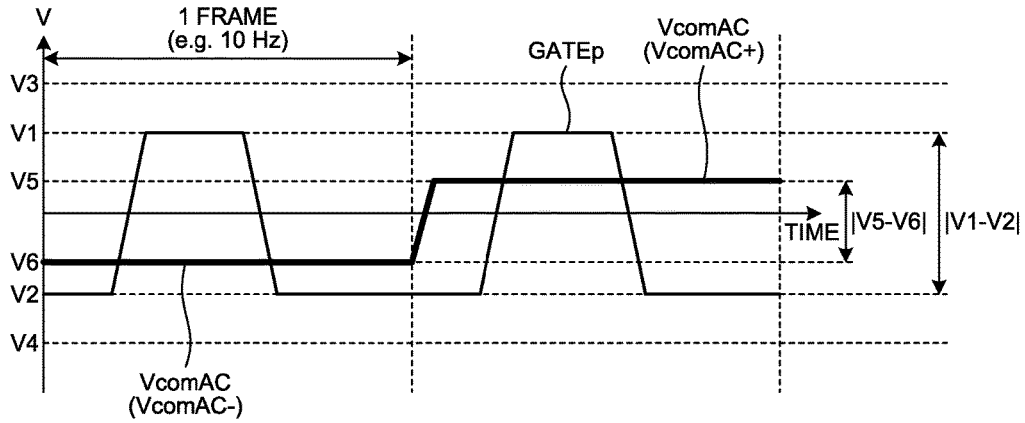
FIGS. 6A to 6C are diagrams each illustrating a waveform example of the frame inversion driving method.
Figure 6B:
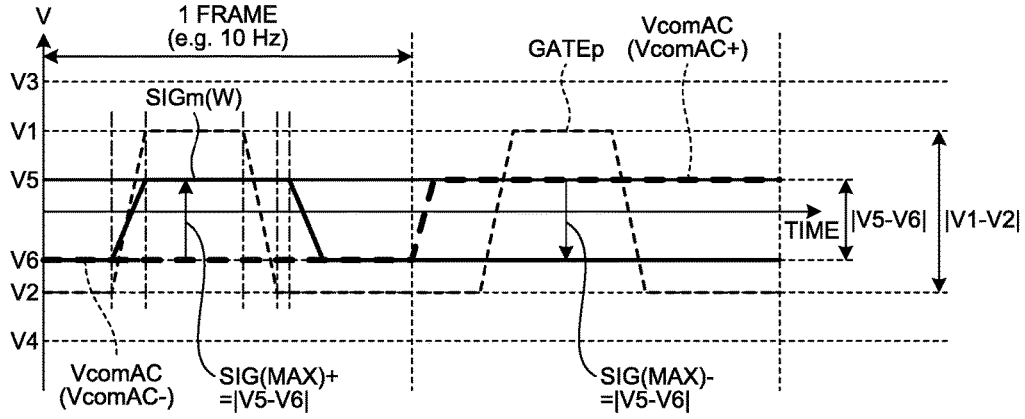
Figure 6C:
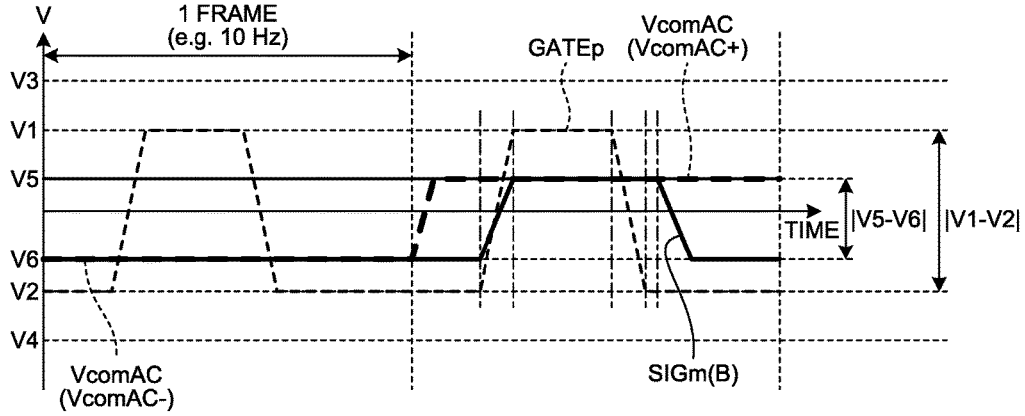

FIGS. 5A and 5B are diagrams each illustrating a driving example of the common electrode and the video signal line in the frame inversion driving method. FIGS. 6A to 6C are diagrams each illustrating a waveform example of the frame inversion driving method. FIGS. 6A to 6C each illustrate a waveform example of each part in the pixel PX in the m-th column and the p-th row. FIG. 6A illustrates waveforms of the gate signal (scanning signal) GATEp and an AC common voltage VcomAC. FIG. 6B illustrates waveforms of a source signal (video signal) SIG(W) (in this case, SIGm(W)) and a source signal (video signal) SIG(MAX) as a maximum value of the source signal (video signal) SIG for generating the source signal (video signal) SIG(W) (in this case, SIGm(W)) in a case of displaying the pixel PX with maximum luminance. FIG. 6C illustrates a waveform of a source signal (video signal) SIG(B) (in this case, SIGm(B)) in a case of displaying the pixel PX with minimum luminance (black). FIGS. 6A to 6C each illustrate a waveform example of a case in which the image display panel 10 is a normally black type liquid crystal display panel.

The frame inversion driving method is different from the column inversion driving method described above in that the AC common voltage VcomAC the polarity of which is inverted in a frame unit is applied to the common electrode VCOM, the polarity of each of the source signals (video signals) SIG1 to SIGn is opposite to the polarity of the AC common voltage VcomAC, and the polarity of each of the source signals (video signals) SIG1 to SIGn is inverted to be opposite to the polarity of the AC common voltage VcomAC in a frame unit.

In the example illustrated in FIGS. 5A and 5B, the voltage applied to the common electrode VCOM is the AC common voltage VcomAC the polarity of which is inverted in a frame unit. The AC common voltage VcomAC has negative polarity (VcomAC−) in the frame (X) (FIG. 5A), and all of the source signals (video signals) SIG (in the example illustrated in FIGS. 5A and 5B, SIGm−1 to SIGm+2) are signals of positive polarity (VcomAC−(+)) with respect to the AC common voltage VcomAC (VcomAC−). In the next frame (X+1) (FIG. 5B), the polarity of the AC common voltage VcomAC is inverted to be positive polarity (VcomAC+) with respect to the frame (X) (FIG. 5A), and all of the source signals (video signals) SIG (in the example illustrated in FIGS. 5A and 5B, SIGm−1 to SIGm+2) are signals of negative polarity (VcomAC+(−)) with respect to the AC common voltage VcomAC (VcomAC+). By repeating the processing illustrated in FIGS. 5A and 5B, the waveform of each part illustrated in FIGS. 6A to 6C can be obtained in the pixel PX in the m-th column and the p-th row.

In the frame inversion driving method, as illustrated in FIGS. 6A to 6C, the polarity of the AC common voltage VcomAC and the polarity of the source signal (video signal) SIG (in this case, SIGm) applied to the source bus line (video signal line) DTL are inverted while keeping opposite polarity in a frame unit, so that each of the source signals (video signals) SIG1 to SIGn (in this case, SIGm) of |V5−V6| [V] (for example, −3 [V] to +2 [V]) is input to each of the source bus lines (video signal lines) DTL. To reproduce the source signal (video signal) SIG (in the example illustrated in FIGS. 6A to 6C, SIGm) of |V5−V6| [V] (for example, −3 [V] to +2 [V]), a peak value of each of the gate signals (scanning signals) GATE1 to GATEq (in the example illustrated in FIGS. 6A to 6C, GATEp) given to each gate bus line (scanning line) SCL needs to be |V1−V2| [V] (for example, about −5 [V] to +5 [V]), which is larger than |V5−V6| [V]. That is, a gate ON voltage V1 [V] (for example, +5 [V]) that is sufficiently higher than a maximum voltage V5 [V] (for example, +2 [V]) of the source signal (video signal) SIG (in this case, SIGm) applied to the source bus line (video signal line) DTL needs to be supplied as the gate positive voltage GVDD+ that gives a high potential side voltage of the gate signals (scanning signals) GATE1 to GATEq, and a gate OFF voltage V2 [V] (for example, −5 [V]) that is sufficiently lower than a minimum voltage V6 [V] (for example, −3 [V]) of the source signal (video signal) SIG (in this case, SIGm) applied to the source bus line (video signal line) DTL needs to be supplied as the gate negative voltage GVDD− that gives a low potential side voltage of the gate signals (scanning signals) GATE1 to GATEq.

FIGS. 6A to 6C each illustrate an example in which a voltage difference SIG(MAX)+ between a negative polarity voltage VcomAC− of the AC common voltage VcomAC and the video signal SIGm(W) for obtaining the maximum luminance is equal to a voltage difference SIG(MAX)− between a positive polarity voltage VcomAC+ of the AC common voltage VcomAC and the video signal SIGm(W) for obtaining the maximum luminance (i.e., (SIG(MAX)+)=(SIG(MAX)−)=|V5−V6|).

As described above, when the image display panel 10 is driven by using the frame inversion driving method, the peak value of the gate signals (scanning signals) GATE1 to GATEq can be reduced as compared with a case in which the image display panel 10 is driven by using the column inversion driving method. That is, when the image display panel 10 is driven by using the frame inversion driving method, the voltage difference between the gate positive voltage GVDD+ that gives a high potential side voltage of the gate signals (scanning signals) GATE1 to GATEq and the gate negative voltage GVDD− that gives a low potential side voltage of the gate signals (scanning signals) GATE1 to GATEq can be reduced as compared with a case in which the image display panel 10 is driven by using the column inversion driving method. Thus, for example, in a case in which the power supply voltage supplied from the power supply circuit 200 of the electronic apparatus to the display device 100 is −5 [V] to +5 [V], the positive polarity voltage +5 [V] needs to be boosted to about +8 [V], and the negative polarity voltage −5 [V] needs to be boosted to about −7 [V], for example, when driving the image display panel 10 by using the column inversion driving method. However, when driving the image display panel 10 by using the frame inversion driving method, the power supply voltage of −5 [V] to +5 [V] supplied from the power supply circuit 200 to the display device 100 does not need to be boosted. That is, in the frame inversion driving method, driving can be performed with lower voltage than that in the column inversion driving method. In the present embodiment, as described above, increasing the negative polarity voltage toward a negative polarity side is referred to as "boosting" similarly to increasing the positive polarity voltage toward a positive polarity side.

That is, by using both of the first display mode in which the image display panel 10 is driven by using the column inversion driving method and the second display mode in which the image display panel 10 is driven by using the frame inversion driving method, power consumption can be reduced.

Figure 7:
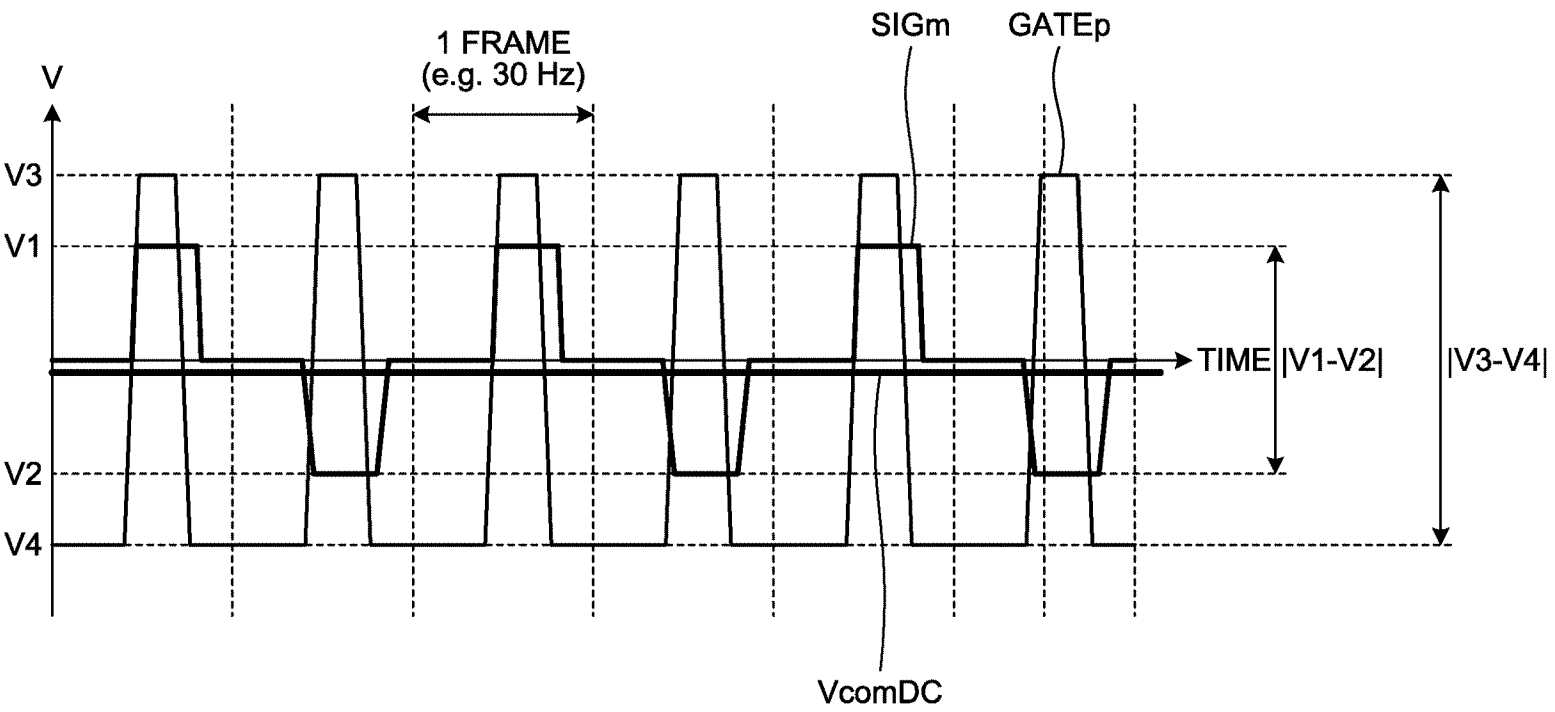
FIG. 7 is a diagram illustrating a comparative waveform example when power consumption is attempted to be reduced using the column inversion driving method.

FIG. 7 is a diagram illustrating a comparative waveform example when power consumption is attempted to be reduced using the column inversion driving method. As illustrated in FIG. 7, even in a case of using the column inversion driving method, a switching frequency of the pixel transistor TR constituting the pixel PX and of each switching element constituting the signal output circuit 21 or the gate drive circuit 22 can be reduced by lowering the frame rate from 60 [Hz] to 30 [Hz], for example, and thus power consumption can be reduced. However, a higher voltage is required for driving as compared with the frame inversion driving method, so that there is a limit on reduction in power consumption.

On the other hand, in the frame inversion driving method, driving can be performed with lower voltage than that in the column inversion driving method, so that power consumption can be reduced, but the common electrode VCOM having a capacitive load larger than that of the source bus line (video signal line) DTL needs to be inverted. Thus, the column inversion driving method is appropriate for increasing the frame rate.

In accordance with characteristics of the driving methods as described above, the image display panel 10 is driven by using the column inversion driving method in which the frame rate can be easily increased in the first display mode, and the image display panel 10 is driven by using the frame inversion driving method in which driving can be performed with lower voltage than that in the column inversion driving method in the second display mode. As illustrated in FIG. 4, for example, the frame rate is set to 60 [Hz] in the first display mode, and as illustrated in FIGS. 6A to 6C, for example, the frame rate is set to 10 [Hz] in the second display mode. By lowering the frame rate, as described above, the switching frequency of the pixel transistor TR constituting the pixel PX and of each switching element constituting the signal output circuit 21 or the gate drive circuit 22 can be reduced, and thus power consumption can be reduced. In this way, even when the frame rate of the second display mode is set to be much lower than that of the first display mode, a sense of incongruity is not given to a user if a display target in the second display mode is video that is not frequently changed.

According to the present embodiment, the source signals (video signals) SIG1 to SIGn transmitted via the source bus line (video signal line) DTL for each pixel column are 256-step gradation voltage signals in the first display mode, and the source signals (video signals) SIG1 to SIGn transmitted via the source bus line (video signal line) DTL for each pixel column are binary signals in the second display mode. That is, an image display panel in which one dot is constituted of, for example, three pixels PX displaying different colors provides multicolor display of 16,770,000 colors in the first display mode, and the image display panel in which one dot is constituted of, for example, three pixels PX displaying different colors provides eight-color display in the second display mode. In this way, with a configuration in which an intermediate color is not displayed in the second display mode, for example, an input video signal from the host processor (control circuit 300) of the electronic apparatus need not be converted into a gradation voltage signal (analog signal) of multi-gradation.

As described above, the present embodiment describes a case in which the image display panel 10 is a normally black type liquid crystal display panel. In this case, in displaying the pixel PX with the maximum luminance in the second display mode, when each of the gate signals (scanning signals) GATE1 to GATEq (in the example illustrated in FIGS. 6A to 6C, GATEp) given to each gate bus line (scanning line) SCL is set to be V1 [V] (for example, about +5 [V]), and electric potential of each of the gate signals (scanning signals) GATE1 to GATEq (in the example illustrated in FIGS. 6A to 6C, GATEp) becomes V2 [V] (for example, −5 [V]) thereafter, electric potential across the pixel capacitor CS of the pixel PX is kept at |V5−V6| [V] (for example, −3 [V] to +2 [V]). When the AC common voltage VcomAC is inverted in this state (from VcomAC− to VcomAC+, or from VcomAC+ to VcomAC−), drain potential of the pixel transistor TR may fluctuate accordingly. More specifically, when the AC common voltage VcomAC is shifted from the negative polarity (VcomAC−) to the positive polarity (VcomAC+), the drain potential of the pixel transistor TR may be increased (V5+((VcomAC+)−(VcomAC−)) [V], for example, about +7 [V]), and when the AC common voltage VcomAC is shifted from the positive polarity (VcomAC+) to the negative polarity (VcomAC−), the drain potential of the pixel transistor TR may be decreased (V6−((VcomAC+)−(VcomAC−)) [V], for example, about −8 [V]). Thus, after a frame in which the AC common voltage VcomAC has the negative polarity (VcomAC−) is shifted to a frame in which the AC common voltage VcomAC has the positive polarity (VcomAC+), even when each of the gate signals (scanning signals) GATE1 to GATEq (in the example illustrated in FIGS. 6A to 6C, GATEp) given to each gate bus line (scanning line) SCL for rewriting the pixel PX is set to be V1 [V] (for example, about +5 [V]), the pixel transistor TR cannot be turned ON and the pixel cannot be rewritten in some cases. When the frame in which the AC common voltage VcomAC has the positive polarity (VcomAC+) is shifted to the frame in which the AC common voltage VcomAC has the negative polarity (VcomAC−), and each of the gate signals (scanning signals) GATE1 to GATEq (in the example illustrated in FIGS. 6A to 6C, GATEp) given to each gate bus line (scanning line) SCL is kept at V2 [V] (for example, about −5 [V]), the pixel transistor TR is unintentionally turned ON, an electric charge of the pixel capacitor CS of the pixel PX leaks, and the pixel PX cannot be kept with the maximum luminance in some cases.

Figure 8:
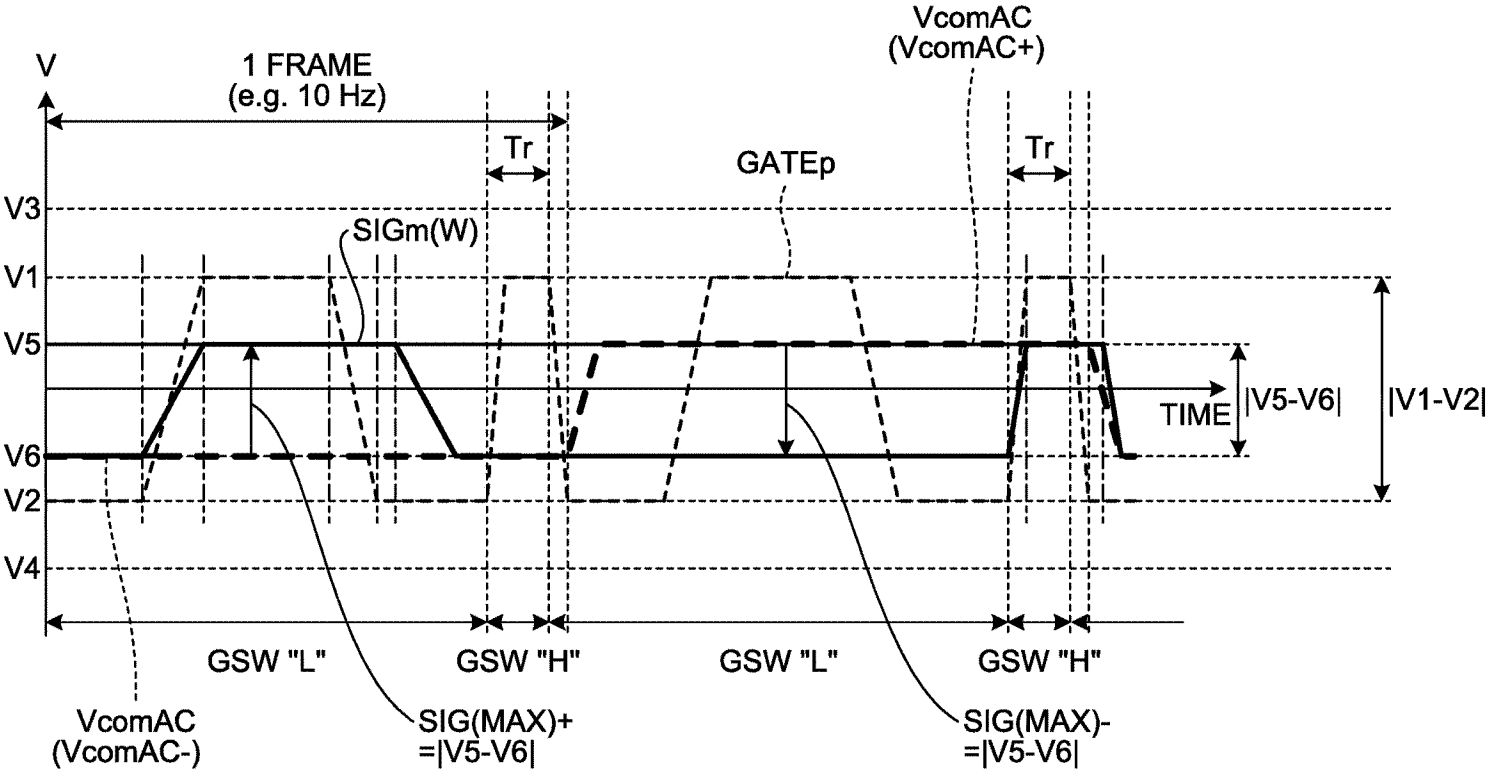
FIG. 8 is a diagram illustrating a waveform example of the frame inversion driving method according to the first embodiment.
Figure 9A:
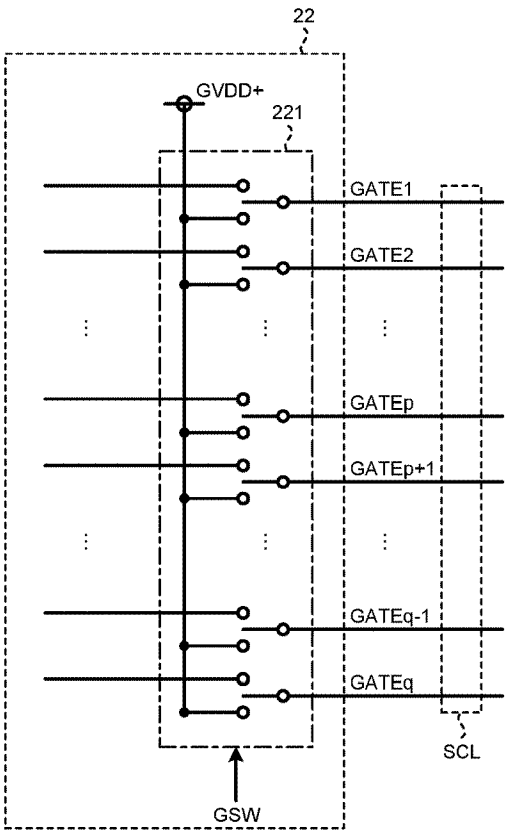
FIGS. 9A to 9C are diagrams each illustrating an internal configuration and an operation example of a gate drive circuit for implementing the frame inversion driving method according to the first embodiment.
Figure 9B:
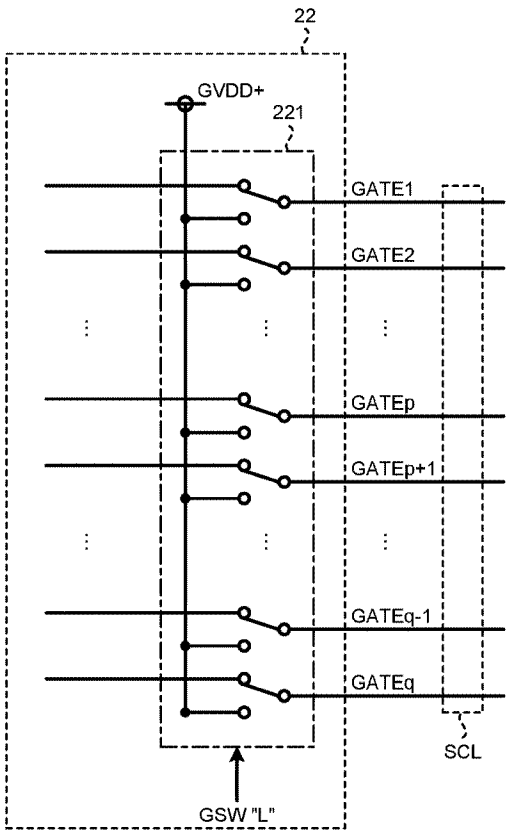
Figure 9C:
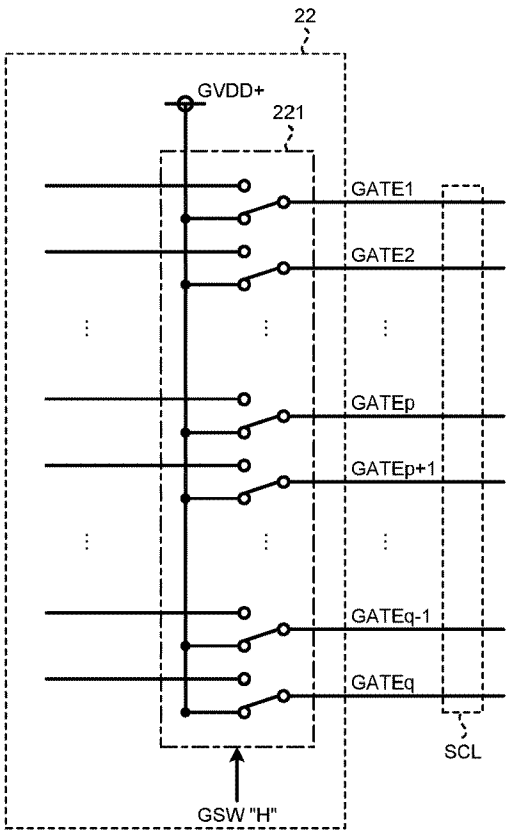

FIG. 8 is a diagram illustrating a waveform example of the frame inversion driving method according to the first embodiment. FIGS. 9A to 9C are diagrams each illustrating an internal configuration and an operation example of the gate drive circuit for implementing the frame inversion driving method according to the first embodiment.

FIG. 8 exemplifies waveforms of the gate signal (scanning signal) GATEp in the pixel PX in the m-th column and the p-th row, the AC common voltage VcomAC, the source signal (video signal) SIG(W) (in this case, SIGm(W)) in a case of displaying the pixel PX with the maximum luminance, and the source signal (video signal) SIG(MAX) as a maximum value of the source signal (video signal) SIG for generating the source signal (video signal) SIG(W) (in this case, SIGm(W)).

In the present embodiment, as illustrated in FIG. 9A, a gate signal changeover switch 221 for switching each of the gate signals (scanning signals) GATE1 to GATEp supplied to the gate bus line (scanning line) SCL to the gate positive voltage GVDD+ is arranged inside the gate drive circuit 22.

As illustrated in FIG. 8, in the frame inversion driving method according to the first embodiment, after writing is performed on the pixel PX in a previous frame and before the AC common voltage VcomAC is inverted, an electric charge resetting period Tr is provided for shifting the gate signal (scanning signal) GATEp from V2 [V] (for example, about −5 [V]) to V1 [V] (for example, about +5 [V]) and causing the electric charge of the pixel capacitor CS of the pixel PX to be discharged. Specifically, as illustrated in FIG. 9C, in the electric charge resetting period Tr after writing is performed on the pixel PX in the previous frame and before the AC common voltage VcomAC is inverted, a gate switching signal GSW is set to "H", and the gate positive voltage GVDD+ is supplied to all gate bus lines (scanning lines) SCL. In a period other than the electric charge resetting period Tr, as illustrated in FIG. 9B, the gate switching signal GSW is set to "L". The electric charge resetting period Tr is provided in a vertical blanking period in which writing is not performed on the pixel PX.

In this way, in the second display mode, by providing the electric charge resetting period Tr in the vertical blanking period in which writing is not performed on the pixel PX before the polarity of the AC common voltage VcomAC is inverted after writing is performed on the pixel PX in the previous frame, in displaying the pixel PX with the maximum luminance in the second display mode when the image display panel 10 is a normally black type liquid crystal display panel, the pixel PX can be normally rewritten after the frame in which the AC common voltage VcomAC has the negative polarity (VcomAC−) is shifted to the frame in which the AC common voltage VcomAC has the positive polarity (VcomAC+).

The gate switching signal GSW for switching all gate bus lines (scanning lines) SCL to the gate positive voltage GVDD+ may be input from the outside of the gate drive circuit 22, or may be generated inside the gate drive circuit 22 after the gate signals (scanning signals) GATE1 to GATEq are output to all the gate bus lines (scanning lines) SCL. Naturally, the configuration for switching all the gate bus lines (scanning lines) SCL to the gate positive voltage GVDD+ is not limited to the configuration illustrated in FIGS. 9A to 9C.

Figure 10:
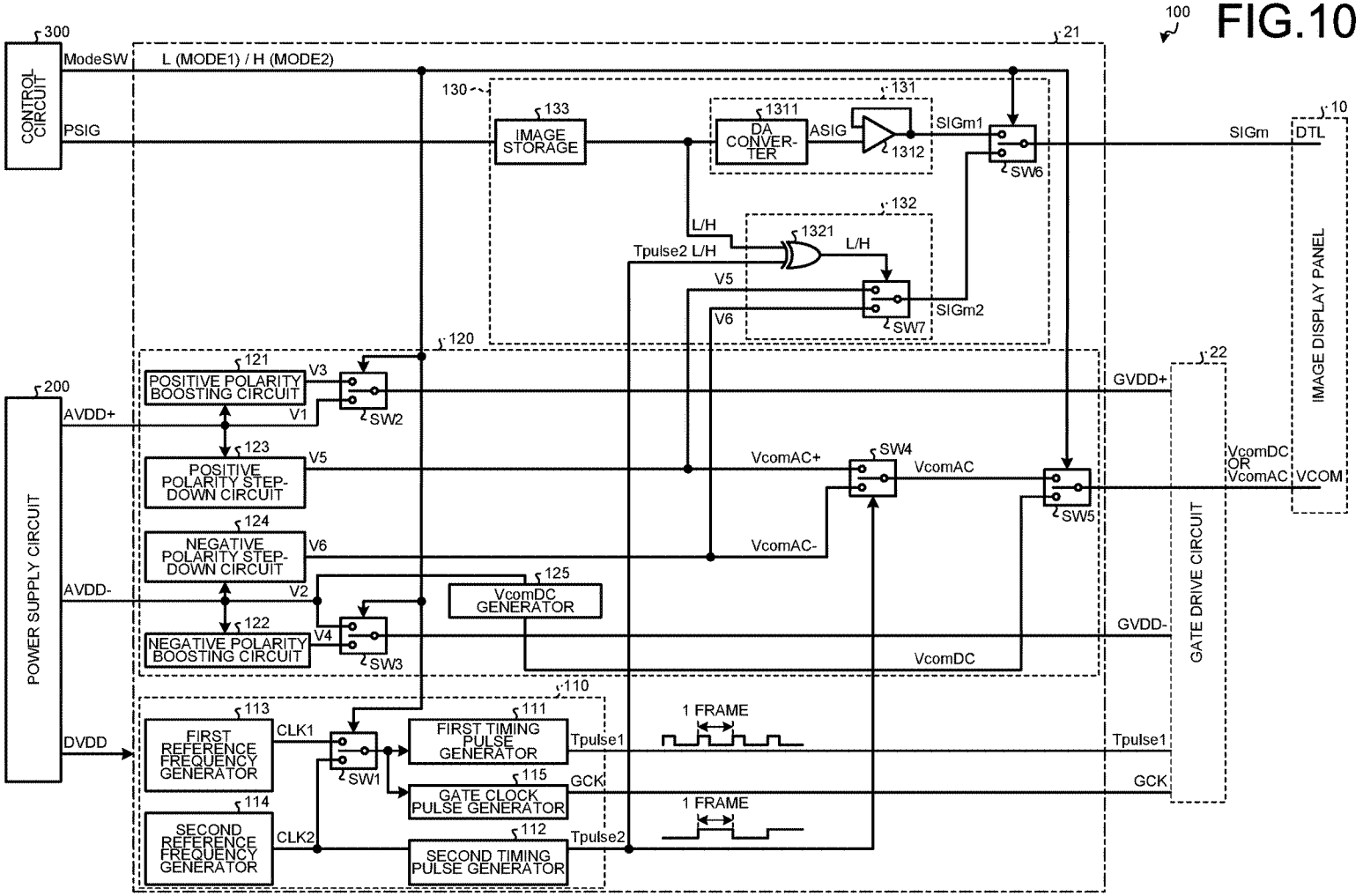
FIG. 10 is a diagram illustrating an example of an internal block configuration of a signal output circuit of the display device according to the first embodiment.

Next, with reference to FIG. 10, the following describes a configuration in which the functions described above can be implemented, i.e., image display with high display quality at a high frame rate using multicolor display in the first display mode, and image display the power consumption of which is reduced at a low frame rate using limited color display in the second display mode can be implemented at the same time. FIG. 10 is a diagram illustrating an example of an internal block configuration of the signal output circuit of the display device according to the first embodiment. In the example illustrated in FIG. 10, components for each pixel PX in the m-th column illustrated in FIG. 2 are illustrated, and components for pixels other than the pixels PX in the m-th column are not illustrated.

As illustrated in FIG. 10, to the signal output circuit 21 according to the present embodiment, an analog positive voltage AVDD+, an analog negative voltage AVDD−, and a digital voltage DVDD are applied from the power supply circuit 200 of the electronic apparatus on which the display device 100 is mounted, for example, and a mode switching signal ModeSW and an input video signal PSIG are input from the control circuit 300 as a host processor of the electronic apparatus, for example.

The signal output circuit 21 outputs the source signal (video signal) SIG (in the example illustrated in FIG. 10, SIGm) to the source bus line (video signal line) DTL of the image display panel 10, and applies the DC common voltage VcomDC or the AC common voltage VcomAC to the common electrode VCOM of the image display panel 10. The signal output circuit 21 also outputs, to the gate drive circuit 22, the first timing pulse Tpulse1 for controlling the output start timing of each of the gate signals (scanning signals) GATE1 to GATEq for each frame, and applies, to the gate drive circuit 22, the gate positive voltage GVDD+ that gives a high potential side voltage of each of the gate signals (scanning signals) GATE1 to GATEq and the gate negative voltage GVDD− that gives a low potential side voltage of each of the gate signals (scanning signals) GATE1 to GATEq.

The signal output circuit 21 of the display device 100 according to the present embodiment includes a timing controller 110, a voltage controller 120, and a signal controller 130.

The timing controller 110 includes a first timing pulse generator 111, a second timing pulse generator 112, a first reference frequency generator 113, a second reference frequency generator 114, a gate clock pulse generator 115, and a first switch SW1. The first timing pulse generator 111 generates the first timing pulse Tpulse1 for controlling the output start timing of each of the gate signals GATE1 to GATEq for each frame. The second timing pulse generator 112 generates a second timing pulse Tpulse2 for switching between the positive polarity voltage VcomAC+(fifth voltage V5) and the negative polarity voltage VcomAC−(sixth voltage V6) of the AC common voltage VcomAC in the second display mode. The first reference frequency generator 113 generates a reference clock signal CLK1 of the first timing pulse Tpulse1 in the first display mode. The second reference frequency generator 114 generates a reference clock signal CLK2 of the first timing pulse Tpulse1 and the second timing pulse Tpulse2 in the second display mode. The gate clock pulse generator 115 generates the gate clock pulse GCK for controlling the output timing of each of the gate signals GATE1 to GATEq based on the reference clock signal CLK1 or the reference clock signal CLK2. The first switch SW1 switches between the reference clock signal CLK1 and the reference clock signal CLK2 based on the mode switching signal ModeSW to be input to the first timing pulse generator 111.

The voltage controller 120 includes a positive polarity boosting circuit 121, a negative polarity boosting circuit 122, a second switch SW2, a third switch SW3, a positive polarity step-down circuit 123, a negative polarity step-down circuit 124, a VcomDC generator 125, a fourth switch SW4, and a fifth switch SW5. The positive polarity boosting circuit 121 boosts the analog positive voltage AVDD+(first voltage V1) and generates the gate positive voltage GVDD+(third voltage V3) in the first display mode. The negative polarity boosting circuit 122 boosts the analog negative voltage AVDD−(second voltage V2) and generates the gate negative voltage GVDD−(fourth voltage V4) in the first display mode. The second switch SW2 switches between the analog positive voltage AVDD+(first voltage V1) and the output voltage (third voltage V3) of the positive polarity boosting circuit 121 based on the mode switching signal ModeSW. The third switch SW3 switches between the analog negative voltage AVDD−(second voltage V2) and the output voltage (fourth voltage V4) of the negative polarity boosting circuit 122 based on the mode switching signal ModeSW. The positive polarity step-down circuit 123 steps down the analog positive voltage AVDD+(first voltage V1) and generates the positive polarity voltage VcomAC+(fifth voltage V5) of the AC common voltage VcomAC in the second display mode. The negative polarity step-down circuit 124 steps down the analog negative voltage AVDD−(second voltage V2) and generates the negative polarity voltage VcomAC−(sixth voltage V6) of the AC common voltage VcomAC in the second display mode. The VcomDC generator 125 generates the DC common voltage VcomDC from the analog negative voltage AVDD−(second voltage V2). The fourth switch SW4 switches between the positive polarity voltage VcomAC+(fifth voltage V5) and the negative polarity voltage VcomAC−(sixth voltage V6) based on the second timing pulse Tpulse2 and generates the AC common voltage VcomAC in the second display mode. The fifth switch SW5 switches between the DC common voltage VcomDC in the first display mode and the AC common voltage VcomAC in the second display mode based on the mode switching signal ModeSW.

Naturally, components for obtaining the third voltage V3, the fourth voltage V4, the fifth voltage V5, and the sixth voltage V6 are not limited to the positive polarity boosting circuit 121, the negative polarity boosting circuit 122, the positive polarity step-down circuit 123, and the negative polarity step-down circuit 124. For example, in the above description, the positive polarity boosting circuit 121 boosts the analog positive voltage AVDD+(first voltage V1) to generate the gate positive voltage GVDD+(third voltage V3) in the first display mode. Alternatively, for example, the positive polarity boosting circuit 121 may be configured to boost the fifth voltage V5 generated by the positive polarity step-down circuit 123 to generate the third voltage V3, or may be configured to generate the third voltage V3 using the first voltage V1 and the fifth voltage V5. For example, in the above description, the negative polarity boosting circuit 122 boosts the analog negative voltage AVDD−(second voltage V2) to generate the gate negative voltage GVDD−(fourth voltage V4) in the first display mode. Alternatively, for example, the negative polarity boosting circuit 122 may be configured to boost the sixth voltage V6 generated by the negative polarity step-down circuit 124 to generate the fourth voltage V4, or may be configured to generate the fourth voltage V4 using the second voltage V2 and the sixth voltage V6. In the above description, the VcomDC generator 125 generates the DC common voltage VcomDC from the analog negative voltage AVDD−(second voltage V2). However, the configuration for generating the DC common voltage VcomDC is not limited thereto.

The signal controller 130 includes a first video signal generator 131, a second video signal generator 132, an image storage 133, and a sixth switch SW6. The first video signal generator 131 generates the source signal (video signal) SIG (in this case, SIGm1) for driving the image display panel 10 using the column inversion driving method in the first display mode. The second video signal generator 132 generates the source signal (video signal) SIG (in this case, SIGm2) for driving the image display panel 10 using the frame inversion driving method in the second display mode. The image storage 133 holds the input video signal PSIG. The sixth switch SW6 switches between the source signal (video signal) SIG (in this case, SIGm1) in the first display mode output from the first video signal generator 131 and the source signal (video signal) SIG (in this case, SIGm2) in the second display mode output from the second video signal generator 132 based on the mode switching signal ModeSW.

The first video signal generator 131 includes a DA converter 1311 and an amplifier 1312. The DA converter 1311 converts the input video signal PSIG held by the image storage 133 to be sequentially output into an analog input signal ASIG. The amplifier 1312 current-amplifies an output from the DA converter 1311 to be the source signal (video signal) SIG (in this case, SIGm1) in the first display mode.

The second video signal generator 132 includes an exclusive OR computing element 1321 and a seventh switch SW7. The exclusive OR computing element 1321 takes an exclusive OR of the input video signal PSIG held by the image storage 133 to be sequentially output and the second timing pulse Tpulse2. The seventh switch SW7 switches between the fifth voltage V5 (i.e., the same voltage as the positive polarity voltage VcomAC+ of the AC common voltage VcomAC in the second display mode) output from the positive polarity step-down circuit 123 and the sixth voltage V6 (i.e., the same voltage as the negative polarity voltage VcomAC− of the AC common voltage VcomAC in the second display mode) output from the negative polarity step-down circuit 124 based on an output from the exclusive OR computing element 1321 to be output as the source signal (video signal) SIG (in this case, SIGm2) in the second display mode.

Figure 11:
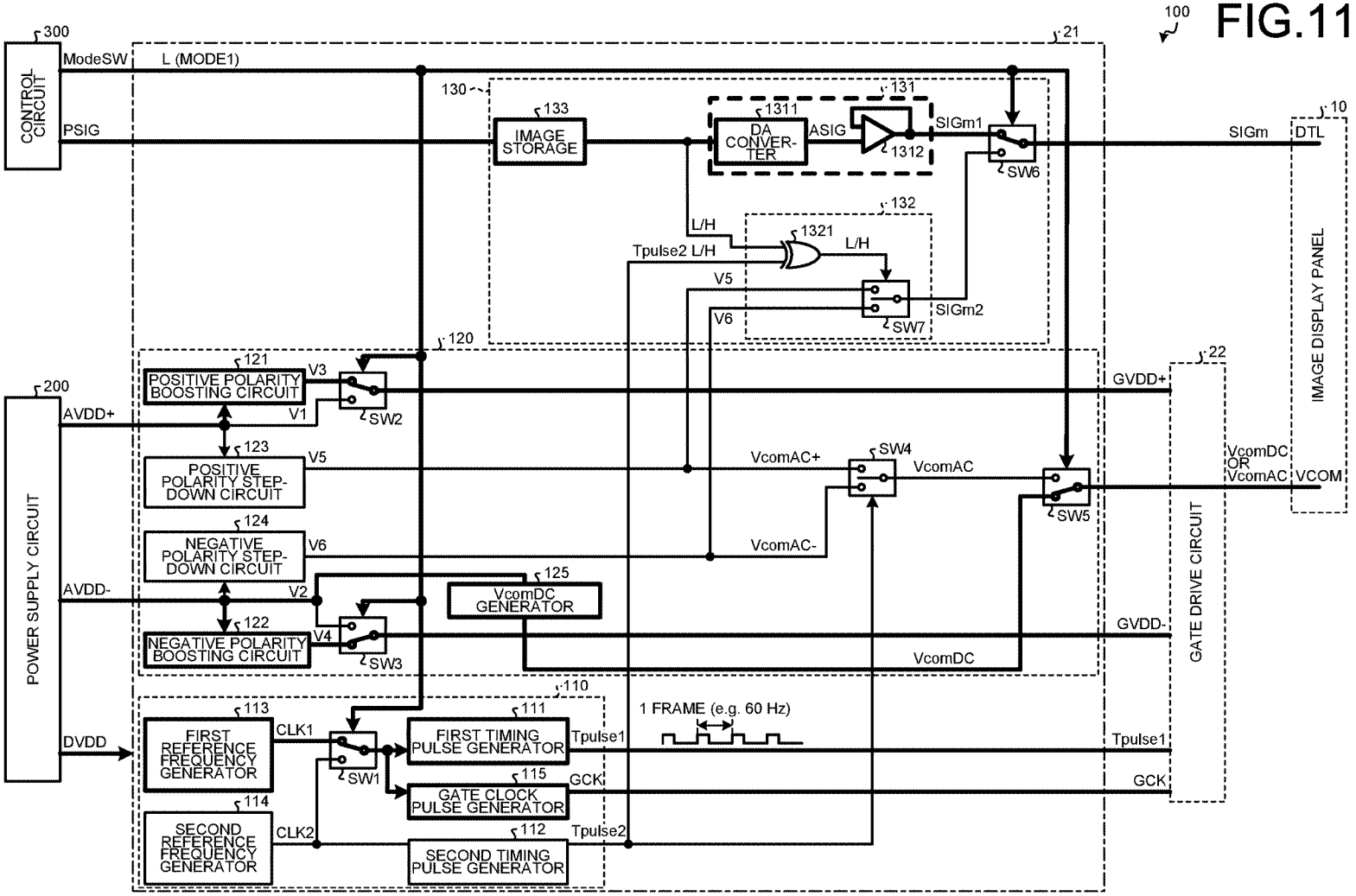
FIG. 11 is a diagram illustrating an operation example in a first display mode according to the first embodiment.
Figure 12:
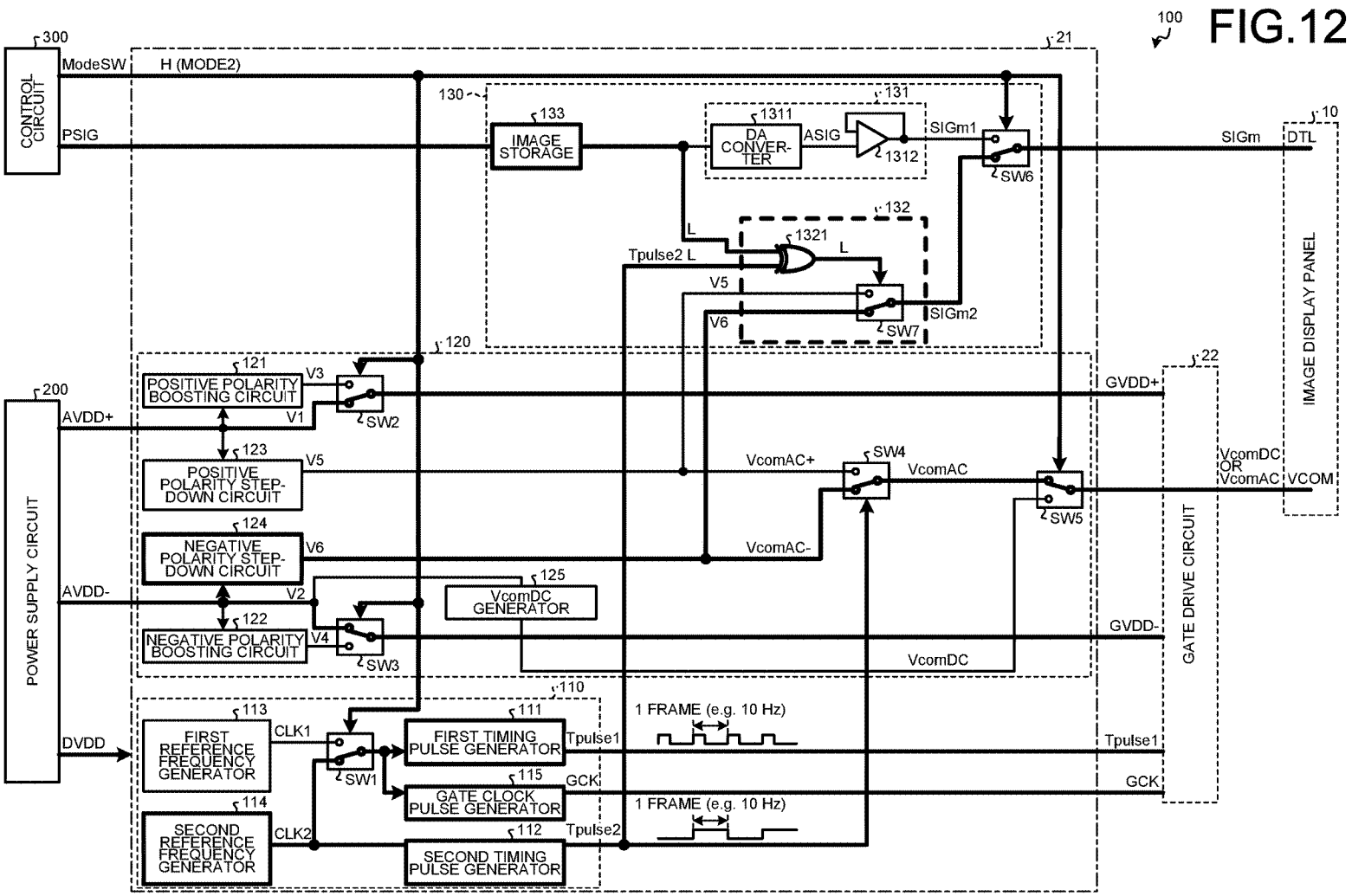
FIG. 12 is a diagram illustrating a first operation example in a second display mode according to the first embodiment.
Figure 13:
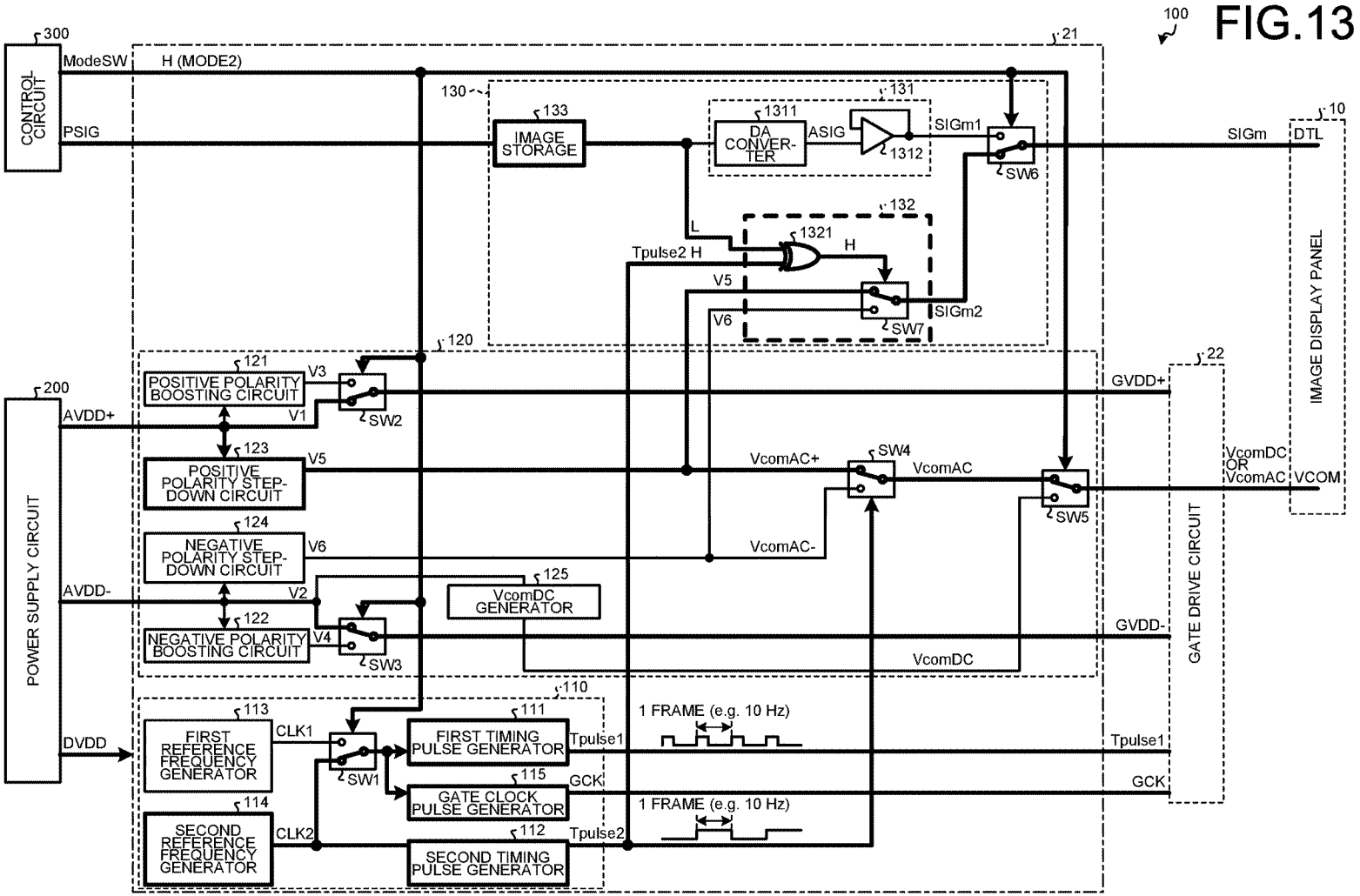
FIG. 13 is a diagram illustrating a second operation example in the second display mode according to the first embodiment.
Figure 15:
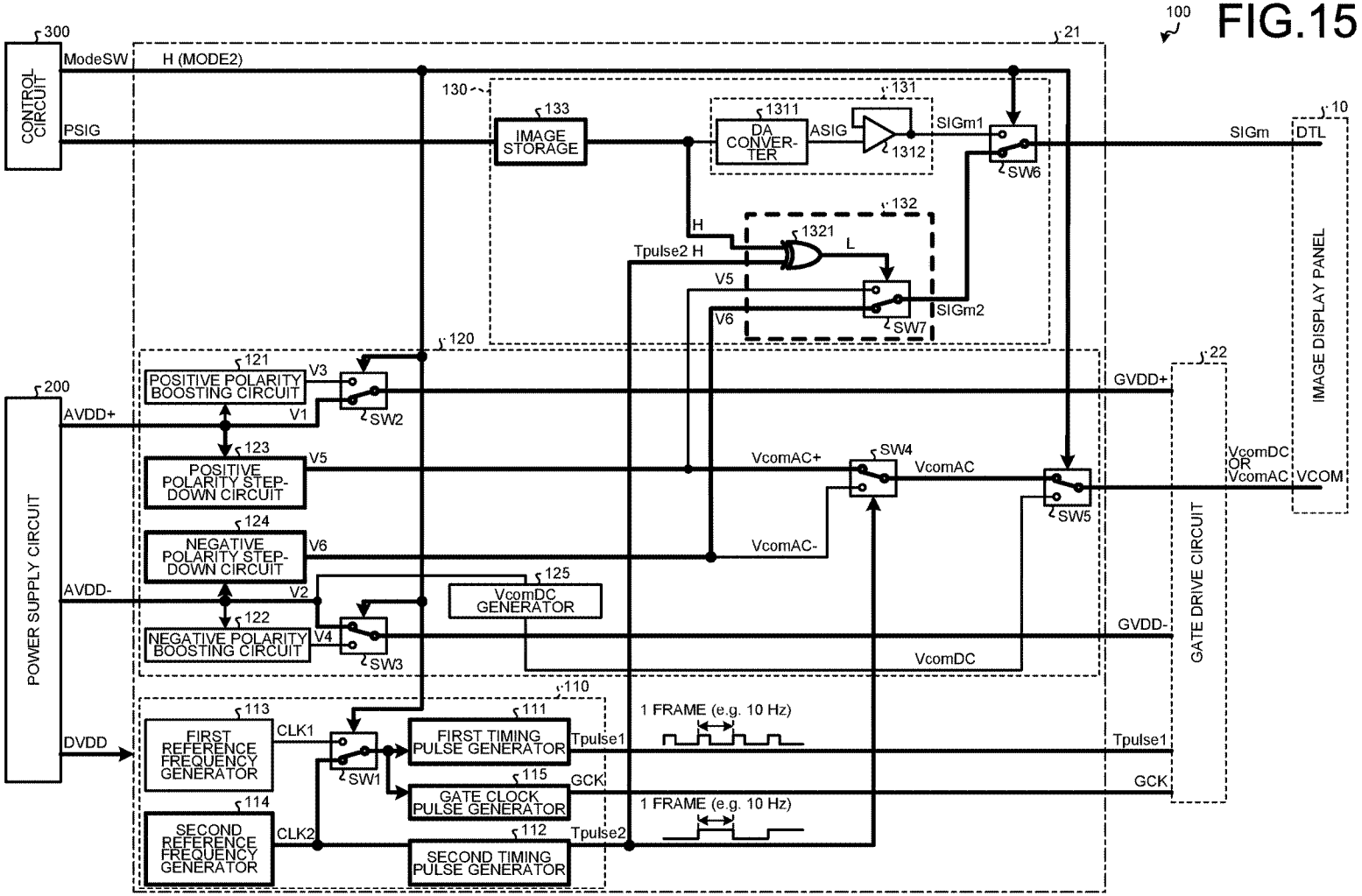
FIG. 15 is a diagram illustrating a fourth operation example in the second display mode according to the first embodiment.

Next, with reference to FIGS. 11 to 15, the following describes an operation of the signal output circuit 21 configured as described above. FIG. 11 is a diagram illustrating an operation example in the first display mode according to the first embodiment. FIG. 12 is a diagram illustrating a first operation example in the second display mode according to the first embodiment. FIG. 13 is a diagram illustrating a second operation example in the second display mode according to the first embodiment. FIG. 14 is a diagram illustrating a third operation example in the second display mode according to the first embodiment. FIG. 15 is a diagram illustrating a fourth operation example in the second display mode according to the first embodiment. FIG. 12 illustrates an operation example in a case in which the input video signal PSIG is "L", i.e., display is performed with the minimum luminance (black) in the second display mode, and the second timing pulse Tpulse2 is "L", i.e., the AC common voltage VcomAC is the negative polarity voltage VcomAC−. FIG. 13 illustrates an operation example in a case in which the input video signal PSIG is "L", i.e., display is performed with the minimum luminance (black) in the second display mode, and the second timing pulse Tpulse2 is "H", i.e., the AC common voltage VcomAC is the positive polarity voltage VcomAC+. FIG. 14 illustrates an operation example in a case in which the input video signal PSIG is "H", i.e., display is performed with the maximum luminance in the second display mode, and the second timing pulse Tpulse2 is "L", i.e., the AC common voltage VcomAC is the negative polarity voltage VcomAC−. FIG. 15 illustrates an operation example in a case in which the input video signal PSIG is "H", i.e., display is performed with the maximum luminance in the second display mode, and the second timing pulse Tpulse2 is "H", i.e., the AC common voltage VcomAC is the positive polarity voltage VcomAC+.

First, the following describes an operation in the first display mode. In the example illustrated in FIG. 11, the mode switching signal ModeSW output from, for example, the control circuit 300 serving as a host processor of an electronic apparatus in the first display mode is assumed to be "L (MODE1)" (first switching signal).

In the first display mode, the reference clock signal CLK1 generated by the first reference frequency generator 113 is selected by the first switch SW1 based on the mode switching signal ModeSW "L (MODE1)", and is input to the first timing pulse generator 111 and the gate clock pulse generator 115.

The first timing pulse generator 111 generates the first timing pulse Tpulse1 for controlling the output start timing of each of the gate signals GATE1 to GATEq for each frame to be output to the gate drive circuit 22. The gate clock pulse generator 115 generates the gate clock pulse GCK for controlling the output timing of each of the gate signals GATE1 to GATEq to be output to the gate drive circuit 22. In the example illustrated in FIG. 11, the frame rate in the first display mode is assumed to be 60 [Hz]. In the first display mode, the second timing pulse Tpulse2 is not required for switching between the positive polarity voltage VcomAC+(fifth voltage V5) and the negative polarity voltage VcomAC−(sixth voltage V6) of the AC common voltage VcomAC given to the common electrode VCOM of the image display panel 10 in the second display mode, so that operations of the second timing pulse generator 112 and the second reference frequency generator 114 may be stopped.

The positive polarity boosting circuit 121 boosts the analog positive voltage AVDD+(first voltage V1) to generate the third voltage V3, and the negative polarity boosting circuit 122 boosts the analog negative voltage AVDD− (second voltage V2) to generate the fourth voltage V4.

At this point, based on the mode switching signal ModeSW "L (MODE1)", the third voltage V3 is selected by the second switch SW2 to be output as the gate positive voltage GVDD+ to the gate drive circuit 22, and the fourth voltage V4 is selected by the third switch SW3 to be output as the gate negative voltage GVDD− to the gate drive circuit 22.

In the first display mode, the AC common voltage VcomAC in the second display mode is not required, so that operations of the positive polarity step-down circuit 123 and the negative polarity step-down circuit 124 for generating the fifth voltage V5 as the positive polarity voltage VcomAC+ of the AC common voltage VcomAC and the sixth voltage V6 as the negative polarity voltage VcomAC− of the AC common voltage VcomAC may be stopped. At this point, based on the mode switching signal ModeSW "L (MODE1)", the DC common voltage VcomDC is selected by the fifth switch SW5 to be output to the image display panel 10.

In the first display mode, the source signal (video signal) SIG (in this case, SIGm2) in the second display mode is not required, so that operations of the exclusive OR computing element 1321 constituting the second video signal generator 132 and the seventh switch SW7 may be stopped.

The DA converter 1311 converts the input video signal PSIG held by the image storage 133 to be sequentially output into the analog input signal ASIG, and the amplifier 1312 current-amplifies the output from the DA converter 1311 to be the source signal (video signal) SIGm1.

At this point, based on the mode switching signal ModeSW "L (MODE1)", the source signal (video signal) SIGm1 is selected by the sixth switch SW6 to be output as the source signal (video signal) SIGm to the image display panel 10.

With the operation in FIG. 11 described above, display is performed in the first display mode using the column inversion driving method.

Next, the following describes an operation in the second display mode. In the examples illustrated in FIGS. 12 to 15, the mode switching signal ModeSW output from, for example, the control circuit 300 serving as a host processor of the electronic apparatus in the second display mode is assumed to be "H (MODE2)" (second switching signal).

First, with reference to FIG. 12, the following describes a case in which display is performed with the minimum luminance (black) when the AC common voltage VcomAC is the negative polarity voltage VcomAC−.

In the second display mode, based on the mode switching signal ModeSW "H (MODE2)", the reference clock signal CLK2 generated by the second reference frequency generator 114 is selected by the first switch SW1 to be input to the first timing pulse generator 111 and the gate clock pulse generator 115, and the reference clock signal CLK2 generated by the second reference frequency generator 114 is input to the second timing pulse generator 112.

The first timing pulse generator 111 generates the first timing pulse Tpulse1 for controlling the output start timing of each of the gate signals GATE1 to GATEq for each frame, and outputs the first timing pulse Tpulse1 to the gate drive circuit 22. The gate clock pulse generator 115 generates the gate clock pulse GCK for controlling the output timing of each of the gate signals GATE1 to GATEq, and outputs the gate clock pulse GCK to the gate drive circuit 22. The second timing pulse generator 112 generates the second timing pulse Tpulse2 for switching between the positive polarity voltage VcomAC+(fifth voltage V5) and the negative polarity voltage VcomAC− (sixth voltage V6) of the AC common voltage VcomAC in the second display mode. In the example illustrated in FIG. 12, the frame rate in the second display mode is assumed to be 10 [Hz].

In the second display mode, the third voltage V3 as the gate positive voltage GVDD+ and the fourth voltage V4 as the gate negative voltage GVDD− in the first display mode are not required, so that operations of the positive polarity boosting circuit 121 and the negative polarity boosting circuit 122 may be stopped. At this point, the first voltage V1 is selected by the second switch SW2 to be output as the gate positive voltage GVDD+ to the gate drive circuit 22, and the second voltage V2 is selected by the third switch SW3 to be output as the gate negative voltage GVDD− to the gate drive circuit 22.

The positive polarity step-down circuit 123 steps down the analog negative voltage AVDD−(second voltage V2) to generate the fifth voltage V5, and the negative polarity step-down circuit 124 steps down the analog negative voltage AVDD−(second voltage V2) to generate the sixth voltage V6.

In the example illustrated in FIG. 12, the second timing pulse Tpulse2 is "L", so that the negative polarity voltage VcomAC−(sixth voltage V6) of the AC common voltage VcomAC is selected by the fourth switch SW4. Based on the mode switching signal ModeSW "H (MODE2)", the AC common voltage VcomAC (in this case, VcomAC−) is selected by the fifth switch SW5 to be output to the image display panel 10.

In the second display mode, the source signal (video signal) SIG (in this case, SIGm1) in the first display mode is not required, so that operations of the DA converter 1311 and the amplifier 1312 constituting the first video signal generator 131 may be stopped. The DC common voltage VcomDC is not required, so that an operation of the VcomDC generator 125 for generating the DC common voltage VcomDC may be stopped.

The exclusive OR computing element 1321 takes an exclusive OR of the input video signal PSIG held by the image storage 133 to be sequentially output and the second timing pulse Tpulse2. In the example illustrated in FIG. 12, the input video signal PSIG is "L" and the second timing pulse Tpulse2 is "L", so that the output from the exclusive OR computing element 1321 becomes "L", and the sixth voltage V6 is selected by the seventh switch SW7 as the source signal (video signal) SIG (in this case, SIGm2) in the second display mode. Based on the mode switching signal ModeSW "H (MODE2)", the source signal (video signal) SIGm2 selected by the seventh switch SW7 is selected by the sixth switch SW6, and is output as the source signal (video signal) SIGm to the image display panel 10.

Next, with reference to FIG. 13, the following describes a case in which display is performed with the minimum luminance (black) when the AC common voltage VcomAC is the positive polarity voltage VcomAC+. The following mainly describes a difference from the case described above in which display is performed with the minimum luminance (black) when the AC common voltage VcomAC is the negative polarity voltage VcomAC−(FIG. 12).

In the example illustrated in FIG. 13, the second timing pulse Tpulse2 is "H", so that the positive polarity voltage VcomAC+(fifth voltage V5) of the AC common voltage VcomAC is selected by the fourth switch SW4. Based on the mode switching signal ModeSW "H (MODE2)", the AC common voltage VcomAC (in this case, VcomAC+) is selected by the fifth switch SW5 to be output to the image display panel 10.

In the example illustrated in FIG. 13, the input video signal PSIG is "L" and the second timing pulse Tpulse2 is "H", so that the output from the exclusive OR computing element 1321 becomes "H", and the fifth voltage V5 is selected by the seventh switch SW7 as the source signal (video signal) SIG (in this case, SIGm2) in the second display mode. Based on the mode switching signal ModeSW "H (MODE2)", the source signal (video signal) SIGm2 selected by the seventh switch SW7 is selected by the sixth switch SW6, and is output as the source signal (video signal) SIGm to the image display panel 10.

Next, with reference to FIG. 14, the following describes a case in which display is performed with the maximum luminance when the AC common voltage VcomAC is the negative polarity voltage VcomAC−. The following mainly describes a difference from the case illustrated in FIG. 12 in which display is performed with the minimum luminance (black) when the AC common voltage VcomAC is the negative polarity voltage VcomAC−.

In the example illustrated in FIG. 14, the second timing pulse Tpulse2 is "L", so that the negative polarity voltage VcomAC− (sixth voltage V6) of the AC common voltage VcomAC is selected by the fourth switch SW4. Based on the mode switching signal ModeSW "H (MODE2)", the AC common voltage VcomAC (in this case, VcomAC−) is selected by the fifth switch SW5 to be output to the image display panel 10.

In the example illustrated in FIG. 14, the input video signal PSIG is "H" and the second timing pulse Tpulse2 is "L", so that the output from the exclusive OR computing element 1321 becomes "H", and the fifth voltage V5 is selected by the seventh switch SW7 as the source signal (video signal) SIG (in this case, SIGm2) in the second display mode. Based on the mode switching signal ModeSW "H (MODE2)", the source signal (video signal) SIGm2 selected by the seventh switch SW7 is selected by the sixth switch SW6, and is output as the source signal (video signal) SIGm to the image display panel 10.

Next, with reference to FIG. 15, the following describes a case in which display is performed with the maximum luminance when the AC common voltage VcomAC is the positive polarity voltage VcomAC+. The following mainly describes a difference from the case illustrated in FIG. 12 in which display is performed with the minimum luminance (black) when the AC common voltage VcomAC is the negative polarity voltage VcomAC−.

In the example illustrated in FIG. 15, the second timing pulse Tpulse2 is "H", so that the positive polarity voltage VcomAC+(fifth voltage V5) of the AC common voltage VcomAC is selected by the fourth switch SW4. Based on the mode switching signal ModeSW "H (MODE2)", the AC common voltage VcomAC (in this case, VcomAC+) is selected by the fifth switch SW5 to be output to the image display panel 10.

In the example illustrated in FIG. 15, the input video signal PSIG is "H" and the second timing pulse Tpulse2 is "H", so that the output from the exclusive OR computing element 1321 becomes "L", and the sixth voltage V6 is selected by the seventh switch SW7 as the source signal (video signal) SIG (in this case, SIGm2) in the second display mode. Based on the mode switching signal ModeSW "H (MODE2)", the source signal (video signal) SIGm2 selected by the seventh switch SW7 is selected by the sixth switch SW6, and is output as the source signal (video signal) SIGm to the image display panel 10.

Through the operations in FIGS. 12 to 15 described above, display is performed in the second display mode using the frame inversion driving method.

The following describes an example in which the first display mode and the second display mode as described above are dynamically switched to each other. In the present embodiment, in response to a request from the host processor (control circuit 300) of the electronic apparatus, for example, the first display mode and the second display mode are dynamically switched to each other. In the examples illustrated in FIGS. 10 to 15 described above, the first display mode and the second display mode are switched to each other by the mode switching signal ModeSW output from the control circuit 300.

In recent years, when the user actively uses the electronic apparatus (hereinafter, also referred to as "when a terminal is used") like a case in which the user views an image such as a static image or a moving image, or a case in which the user selects an application icon displayed on the image display panel to operate the electronic apparatus, smoothness of the moving image and screen transition is demanded, so that display at a high frame rate needs to be performed. At the same time, multicolor display is demanded for reproducing smooth gradation of colors and luminance of the static image and the moving image. Typically, to increase the frame rate and implement multicolor display as described above, power consumption is increased.

When the user does not actively use the electronic apparatus (hereinafter, also referred to as "when the terminal stands by"), processing of reducing power consumption is typically performed such as limiting an operation of each component of the electronic apparatus. On the other hand, even when the terminal stands by, it is demanded that the user can check, at arbitrary timing, minimum necessary information based on character information such as a calendar, clock display, or a pop-up screen for notifying reception of e-mail, and an emergency earthquake report. Such minimum necessary information based on character information that is displayed when the terminal stands by is preferably displayed with coloring having higher visibility than that of multicolor display that is required when the terminal is used.

In the display device 100 according to the present embodiment, the image display panel 10 is driven by using the column inversion driving method in which the frame rate can be increased, and multicolor display is performed for reproducing smooth gradation of colors and luminance of the static image and the moving image in the first display mode. Additionally, in the second display mode, the image display panel 10 is driven by using the frame inversion driving method in which driving can be performed with lower voltage than that in the column inversion driving method, and display is performed by limiting the number of colors to be displayed as compared with the first display mode. Accordingly, in the second display mode, operations of the positive polarity boosting circuit 121 that generates the third voltage V3 and the negative polarity boosting circuit 122 that generates the fourth voltage V4 required for the column inversion driving method in the first display mode, and operations of the DA converter 1311 and the amplifier 1312 constituting the first video signal generator 131 required for performing multicolor display can be stopped, so that power consumption can be reduced.

Additionally, by driving the image display panel 10 at a frame rate lower than that in the first display mode, the switching frequency of the pixel transistor TR constituting the pixel PX and that of each switching element constituting the signal output circuit 21 and the gate drive circuit 22 can be reduced, and power consumption can be reduced, so that the power consumption can be further reduced.

Thus, in the present embodiment, the display device 100 according to the present embodiment is mounted on the electronic apparatus, operated in the first display mode when the terminal is used, and operated in the second display mode when the terminal stands by in accordance with the mode switching signal ModeSW output from the control circuit 300 serving as a host processor of the electronic apparatus, for example. More specifically, the second display mode is switched to the first display mode in accordance with "L (MODE1)" (first switching signal) of the mode switching signal ModeSW, and the first display mode is switched to the second display mode in accordance with "H (MODE2)" (second switching signal) of the mode switching signal ModeSW. Accordingly, for example, while image display with high display quality is implemented at a high frame rate using multicolor display in the first display mode when the terminal is used, image display with reduced power consumption is implemented at a low frame rate and by limited color display in the second display mode when the terminal stands by, for example. In this way, by using both of the first display mode and the second display mode, image display with high display quality and reduction in power consumption can be implemented at the same time.

The signal output circuit 21 and the gate drive circuit 22 included in the image display panel driver 20 may be mounted, for example, on one driver IC (semiconductor device). Alternatively, any one of the signal output circuit 21 and the gate drive circuit 22 or part of components included in the signal output circuit 21 and the gate drive circuit 22 may be mounted, for example, on one driver IC (semiconductor device), and the other components may be mounted on the image display panel 10. The mounting method for the components included in the image display panel driver 20 does not limit the present invention.

First Modification

In the example described above, in a case in which the image display panel 10 is a normally black type liquid crystal display panel, the electric charge resetting period Tr is provided, in the vertical blanking period in which writing is not performed on the pixel PX before the polarity of the AC common voltage VcomAC is inverted after writing is performed on the pixel PX in the previous frame, so that the gate signal (scanning signal) GATEp is shifted from V2 [V] (for example, about −5 [V]) to V1 [V] (for example, about +5 [V]) and the electric charge of the pixel capacitor CS of the pixel PX is discharged. In this case, in a period after the frame in which the AC common voltage VcomAC has the positive polarity (VcomAC+) is shifted to the frame in which the AC common voltage VcomAC has the negative polarity (VcomAC−) until the pixel PX is rewritten, display is performed with the minimum luminance (black) irrespective of the state of the source signal (video signal) SIG. Specifically, in a lower part of the display region 11, a period from when the pixel PX is reset in the previous frame until the pixel PX is rewritten in the next frame is prolonged. Thus, when image display is performed at a low frame rate such as 10 [Hz] in the second display mode in which the image display panel 10 is driven by using the frame inversion driving method, display with the minimum luminance (black) tends to be visually recognized in a period from when the pixel PX is reset in the previous frame until the pixel PX is rewritten in the next frame in the lower part of the display region 11.

Thus, in the second display mode in which the image display panel 10 is driven by using the frame inversion driving method, it can be considered that the display region 11 is divided into a plurality of regions in a scanning direction, and that image display is performed in any of the regions. That is, by limiting the width in the scanning direction of the region in which image display is performed, flicker in a displayed image is hardly visually recognized. The following describes an example in which the display region 11 is divided into two regions in the scanning direction, image display is performed only in an upper region of the display region 11 in which writing is performed on the pixel PX in a previous part of one frame period, and image display is not performed in a lower region of the display region 11 in which writing is performed on the pixel PX in the latter part of one frame period (display is always performed with the minimum luminance (black)).

Figure 16:
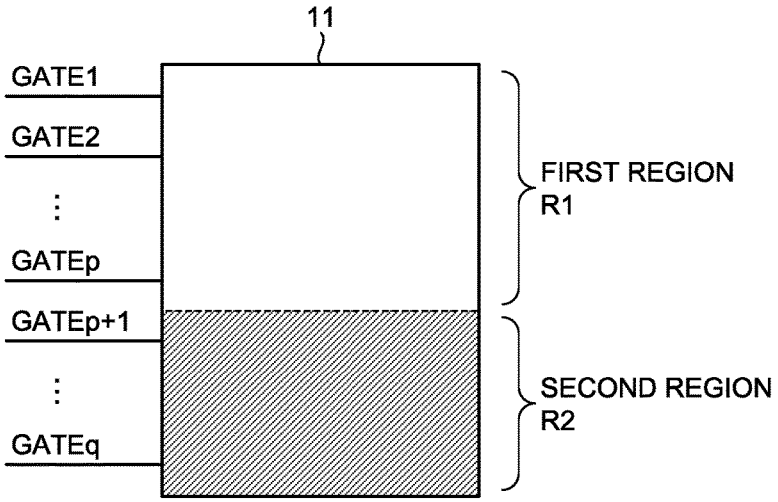
FIG. 16 is a diagram illustrating an example of a first region in which image display is performed and a second region in which image display is not performed in the second display mode according to a first modification of the first embodiment.
Figure 17:
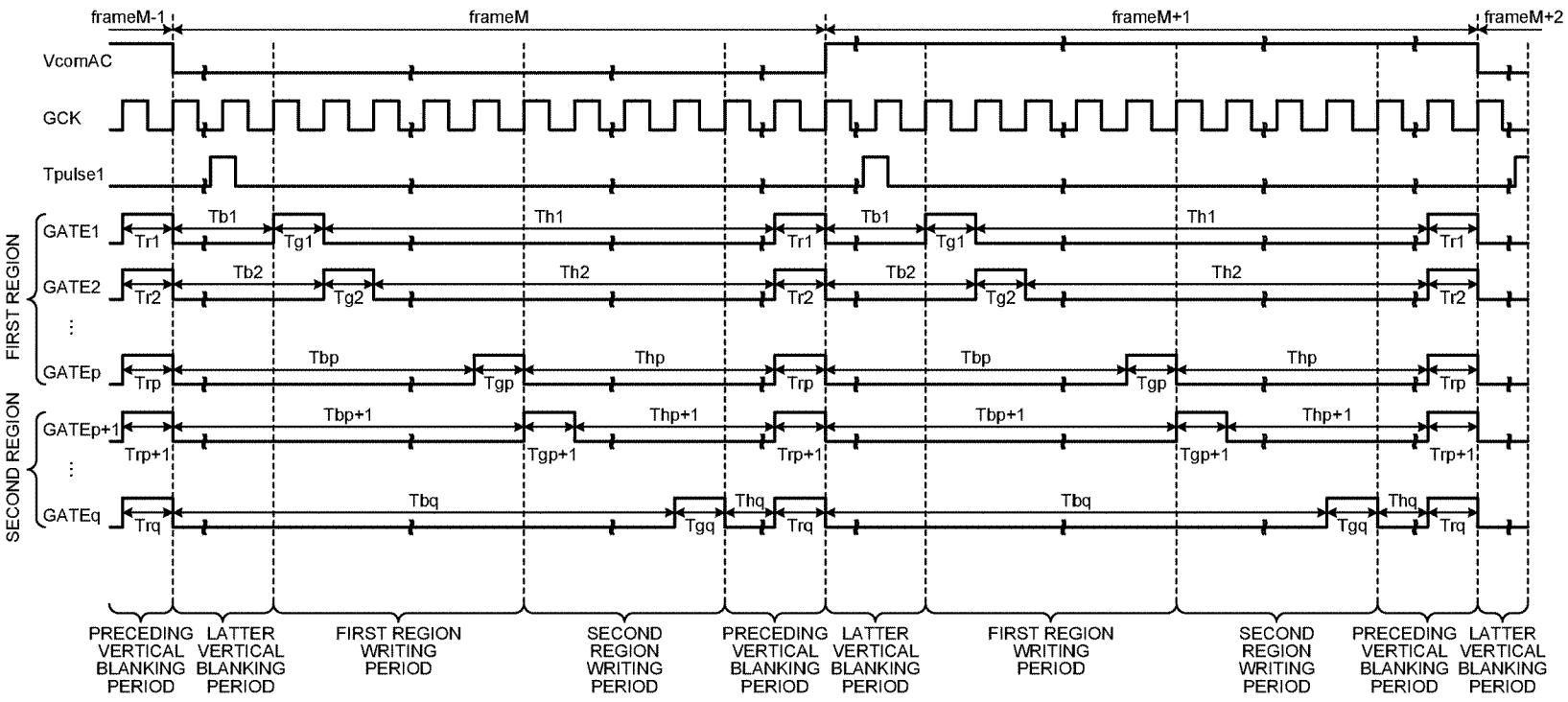
FIG. 17 is a diagram illustrating an example of a timing chart in the second display mode according to the first modification of the first embodiment.

FIG. 16 is a diagram illustrating an example of the first region in which image display is performed and the second region in which image display is not performed in the second display mode according to a first modification of the first embodiment. FIG. 17 is a diagram illustrating an example of a timing chart in the second display mode according to the first modification of the first embodiment.

In the example illustrated in FIG. 16, in the display region 11, a first region R1 in which the gate signals (scanning signals) GATE1 to GATEp are supplied is assumed to be a region in which image display is performed, and a second region R2 in which the gate signals (scanning signals) GATEp+1 to GATEq are supplied is assumed to be a region in which image display is not performed (display is always performed with the minimum luminance (black)).

In the example illustrated in FIG. 17, in a preceding vertical blanking period in frameM−1 before frameM, electric charge resetting periods Tr1, Tr2, . . . , Trp, Trp+1, . . . , and Trq are provided in which the gate signals (scanning signals) GATEp+1 to GATEq are turned ON(H) to cause electric charges of pixel capacitors CS of all the pixels PX in the display region 11 to be discharged.

When the electric charges of the pixel capacitors CS of all the pixels PX in the display region 11 are discharged in the electric charge resetting periods Tr1, Tr2, . . . , Trp, Trp+1, . . . , and Trq, in frameM thereafter, display is performed with the minimum luminance (black) irrespective of the state of the source signal (video signal) SIG as described above in periods Tb1, Tb2, . . . , Tbp, Tbp+1, . . . , and Tbq until the gate signals (scanning signals) GATEp+1 to GATEq are turned ON(H) in gate ON periods Tg1, Tg2, . . . , Tgp, Tgp+1, . . . , and Tgq in which writing is performed for performing image display on each pixel PX in the display region 11.

Hereinafter, each of the periods Tb1, Tb2, . . . , Tbp, Tbp+1, . . . , and Tbq is also referred to as a "minimum luminance display period", the periods Tb1, Tb2, . . . , Tbp, Tbp+1, . . . , and Tbq after the electric charges of the pixel capacitors CS of all the pixels PX in the display region 11 are discharged in the electric charge resetting periods Tr1, Tr2, . . . , Trp, Trp+1, . . . , and Trq until the gate signals (scanning signals) GATEp+1 to GATEq are turned ON(H). In the example illustrated in FIG. 17, the minimum luminance display period is assumed to include the latter vertical blanking period.

Hereinafter, each of periods Th1, Th2, . . . , Thp, Thp+1, . . . , and Thq is referred to as a "video holding period", i.e., the periods Th1, Th2, . . . , Thp, Thp+1, . . . , and Thq are periods after the gate signals (scanning signals) GATEp+1 to GATEq are turned ON(H) in the gate ON periods Tg1, Tg2, . . . , Tgp, Tgp+1, . . . , and Tgq and writing for performing image display is performed on each pixel PX in the display region 11 until the electric charges of the pixel capacitors CS of all the pixels PX in the display region 11 are discharged in the electric charge resetting periods Tr1, Tr2, . . . , Trp, Trp+1, . . . , and Trq in frameM.

In the second display mode according to the first modification of the first embodiment, a region having a short minimum luminance display period in which display with the minimum luminance (black) is hardly visually recognized (in the examples illustrated in FIGS. 16 and 17, a region in which the gate signals (scanning signals) GATE1 to GATEp are supplied) is assumed to be the first region R1 in which image display is performed, and a region lower than the first region R1 (in the examples illustrated in FIGS. 16 and 17, a region in which the gate signals (scanning signals) GATEp+1 to GATEq are supplied) is assumed to be the second region R2 in which image display is not performed (display is always performed with the minimum luminance (black)).

In the first region R1 (in the examples illustrated in FIGS. 16 and 17, the region in which the gate signals (scanning signals) GATE1 to GATEp are supplied), after writing for performing image display is performed on the pixel PX included in the first region R1 in the gate ON periods Tg1, Tg2, . . . , and Tgp in the first region writing period as a writing period for each pixel PX included in the first region R1, the electric charge of the pixel capacitor CS of the pixel PX included in the first region R1 is held in the subsequent video holding periods Th1, Th2, . . . , and Thp. Accordingly, image display in the first region R1 is maintained.

In the second region R2 (in the examples illustrated in FIGS. 16 and 17, the region in which the gate signals (scanning signals) GATEp+1 to GATEq are supplied), after writing is performed for displaying each pixel PX included in the second region R2 with the minimum luminance (black), i.e., the electric charge of the pixel capacitor CS of each pixel PX included in the second region R2 is discharged in the gate ON periods Tgp+1, . . . , and Tgq in a second region writing period as a writing period for each pixel PX included in the second region R2, the electric charge of the pixel capacitor CS of each pixel PX included in the second region R2 is kept being discharged in the subsequent video holding periods Thp+1, . . . , and Thq. Accordingly, display with the minimum luminance (black) is maintained in the second region R2.

By performing similar processing for frameM+1 and subsequent frames, even when an electric charge resetting period is provided for discharging the electric charges of the pixel capacitors CS of all the pixels PX in the display region 11 for each frame in the second display mode, flicker in the displayed image can be prevented from being visually recognized in the first region R1 in which image display is performed.

Second Modification

To prevent flicker in the displayed image from being visually recognized, it is possible to consider, in addition to the first modification described above, a configuration to speed up the gate clock pulse GCK output from the gate clock pulse generator 115, i.e., to make the frequency of the gate clock pulse GCK higher than that in the first modification of the first embodiment.

Figure 18:
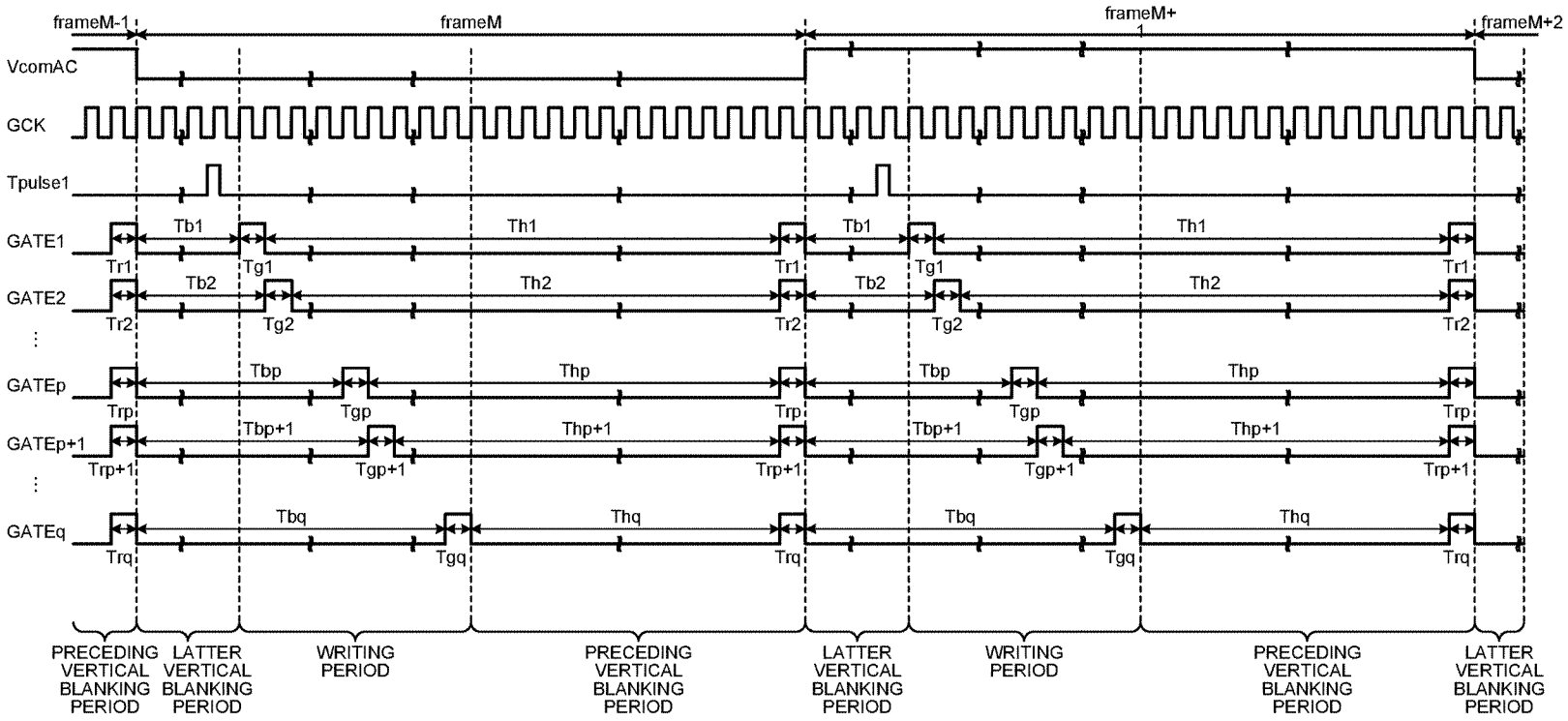
FIG. 18 is a diagram illustrating an example of a timing chart in the second display mode according to a second modification of the first embodiment.

FIG. 18 is a diagram illustrating an example of a timing chart in the second display mode according to a second modification of the first embodiment. The periods illustrated in FIG. 18 are the same as those in FIG. 17 according to the first modification of the first embodiment, so that duplicated descriptions will be omitted.

In the example illustrated in FIG. 18, similarly to the first modification of the first embodiment, in the preceding vertical blanking period in frameM−1 before frameM, the electric charge resetting periods Tr1, Tr2, . . . , Trp, Trp+1, . . . , and Trq are provided in which the gate signals (scanning signals) GATEp+1 to GATEq are turned ON(H) to cause the electric charges of the pixel capacitors CS of all the pixels PX to be discharged.

When the electric charges of the pixel capacitors CS of all the pixels PX are discharged in the electric charge resetting periods Tr1, Tr2, . . . , Trp, Trp+1, . . . , and Trq, display is performed with the minimum luminance (black) in minimum luminance display periods Tb1, Tb2, . . . , Tbp, Tbp+1, . . . , and Tbq in frameM thereafter irrespective of the state of the source signal (video signal) SIG. If each of the minimum luminance display periods Tb1, Tb2, . . . , Tbp, Tbp+1, . . . , and Tbq is longer than 10 [ms], for example, there is a higher probability that flicker in the displayed image is visually recognized. To prevent flicker in the displayed image from being visually recognized, each of the minimum luminance display periods Tb1, Tb2, . . . , Tbp, Tbp+1, . . . , and Tbq is preferably equal to or shorter than 10 [ms], for example.

In the second display mode according to the second modification of the first embodiment, as described above, by speeding up the gate clock pulse GCK output from the gate clock pulse generator 115 as compared with the second display mode according to the first modification of the first embodiment, each of the minimum luminance display periods Tb1, Tb2, . . . , Tbp, Tbp+1, . . . , and Tbq can be shortened as compared with the first modification of the first embodiment. Accordingly, each of the video holding periods Th1, Th2, . . . , Thp, Thp+1, . . . , and Thq can be prolonged as compared with the first modification of the first embodiment. As a result, the writing period for all the pixels PX in the display region 11 within one frame period is shortened, and the preceding vertical blanking period is prolonged. For example, the frequency of the gate clock pulse GCK is set so that the writing period for all the pixels PX in the display region 11 within one frame period is sufficiently shorter than the vertical blanking period (total period of the preceding vertical blanking period and the latter vertical blanking period). As described above, if each of the minimum luminance display periods Tb1, Tb2, . . . , Tbp, Tbp+1, . . . , and Tbq is shorter than 10 [ms], for example, there is a lower probability that flicker in the displayed image is visually recognized. Thus, in the present embodiment, the frequency of the gate clock pulse GCK is set so that the writing period for all the pixels PX in the display region 11 within one frame period is equal to or shorter than 10 [ms], for example.

Accordingly, even when the electric charge resetting period is provided for discharging the electric charges of the pixel capacitors CS of all the pixels PX in the display region 11 for each frame in the second display mode, flicker in the displayed image can be prevented from being visually recognized in the entire display region 11 without providing the second region R2 in which image display is not performed (display is always performed with the minimum luminance (black)).

The first modification and the second modification of the first embodiment described above can be combined with each other. For example, by slowing down the gate clock pulse GCK output from the gate clock pulse generator 115 to implement the second display mode using the first modification of the first embodiment, an effect of reducing power consumption in the second display mode can be improved. When the second display mode is attempted to be implemented using the second modification of the first embodiment, there is a narrower region in which display with the minimum luminance (black) is hardly visually recognized, and the first region R1 required for displaying a desired image can be secured.

By combining the first modification and the second modification of the first embodiment described above, and setting the frequency of the gate clock pulse GCK so that the first region writing period within one frame period is, for example, equal to or shorter than 10 [ms] while securing the first region R1 required for displaying a desired image, the second display mode can be implemented in which the first region R1 required for displaying a desired image is secured and the effect of reducing power consumption is exhibited at the same time.

In the example described above, the image display panel 10 is assumed to be a normally black type liquid crystal display panel. The same applies to a case in which the image display panel 10 is a normally white type liquid crystal display panel. That is, in the normally white type liquid crystal display panel, in displaying the pixel PX with the minimum luminance (black) in the second display mode, when the gate signal (scanning signal) given to each gate bus line (scanning line) SCL is set to be about +5 [V], for example, and the electric potential of the gate signal (scanning signal) becomes −5 [V] thereafter, for example, electric potential across the pixel capacitor CS of the pixel PX is kept at −3 [V] to +2 [V], for example. When the AC common voltage VcomAC is inverted in this state, the drain potential of the pixel transistor TR may fluctuate accordingly. More specifically, when the AC common voltage VcomAC is shifted from the negative polarity to the positive polarity, the drain potential of the pixel transistor TR may be increased to about +7 [V], for example, and when the AC common voltage VcomAC is shifted from the positive polarity to the negative polarity, the drain potential of the pixel transistor TR may be decreased to about −8 [V], for example. Thus, even when the frame in which the AC common voltage VcomAC has the negative polarity is shifted to the frame in which the AC common voltage VcomAC has the positive polarity, and the gate signal (scanning signal) given to each gate bus line (scanning line) SCL for rewriting the pixel PX is set to be about +5 [V], for example, the pixel transistor TR cannot be turned ON and the pixel cannot be rewritten in some cases. When the frame in which the AC common voltage VcomAC has the positive polarity is shifted to the frame in which the AC common voltage VcomAC has the negative polarity, and the gate signal (scanning signal) given to each gate bus line (scanning line) SCL is kept at about −5 [V], for example, the pixel transistor TR is unintentionally turned ON, the electric charge of the pixel capacitor CS of the pixel PX leaks, and the pixel PX cannot be kept with the minimum luminance (black) in some cases.

Thus, also in the case in which the image display panel 10 is a normally white type liquid crystal display panel, similarly to the case in which the image display panel 10 is a normally black type liquid crystal display panel, the gate signal changeover switch 221 is arranged inside the gate drive circuit 22 for switching the gate signal (scanning signal) supplied to the gate bus line (scanning line) SCL illustrated in FIG. 9A to a gate positive voltage, and the electric charge resetting period Tr is provided for shifting the gate signal (scanning signal) from about −5 [V] to about +5 [V], for example, and discharging the electric charge of the pixel capacitor CS of the pixel PX, in the vertical blanking period in which writing is not performed on the pixel PX before the polarity of the AC common voltage VcomAC is inverted after writing is performed on the pixel PX in the previous frame. Accordingly, also in the case in which the image display panel 10 is a normally white type liquid crystal display panel, similarly to the case described above in which the image display panel 10 is a normally black type liquid crystal display panel, the pixel can be normally rewritten after the frame in which the AC common voltage VcomAC has the negative polarity (VcomAC−) is shifted to the frame in which the AC common voltage VcomAC has the positive polarity (VcomAC+).

Also in the case in which the image display panel 10 is a normally white type liquid crystal display panel, similarly to the case described above in which the image display panel 10 is a normally black type liquid crystal display panel, even when the electric charge resetting period is provided for discharging the electric charges of the pixel capacitors CS of all the pixels PX in the display region 11 for each frame in the second display mode, flicker in the displayed image can be prevented from being visually recognized in the first region R1 in which image display is performed by implementing the second display mode using the first modification of the first embodiment described above. By implementing the second display mode using the second modification of the first embodiment described above, flicker in the displayed image can be prevented from being visually recognized in the entire display region 11 without providing the second region R2 in which image display is not performed (display is always performed with the maximum luminance (white)). By implementing the second display mode by combining the first modification and the second modification of the first embodiment described above, the second display mode can be implemented in which the first region R1 required for displaying a desired image is secured and the effect of reducing power consumption is exhibited at the same time.

As described above, the display device 100 according to the first embodiment can switch between the first display mode in which the image display panel 10 is driven by using the column inversion driving method capable of increasing the frame rate, and the second display mode in which the image display panel 10 is driven by using the frame inversion driving method capable of performing driving with lower voltage than that in the column inversion driving method. Accordingly, image display with high display quality and reduction in power consumption can be implemented at the same time.

Specifically, in the second display mode, the boosting circuits (the positive polarity boosting circuit 121 and the negative polarity boosting circuit 122) that become unnecessary due to driving with lower voltage in the frame inversion driving method are stopped.

In the second display mode, the DA converter 1311 and the amplifier 1312 included in the first video signal generator 131 that become unnecessary due to limited color display are stopped.

In the second display mode, the image display panel 10 is driven at a lower frame rate than that in the first display mode.

Accordingly, power consumption in the second display mode can be reduced as compared with power consumption in the first display mode. Thus, both of image display with high display quality at a high frame rate using multicolor display in the first display mode and reduction in power consumption at a low frame rate using limited color display in the second display mode can be implemented.

The present embodiment can provide the display device 100 that can implement image display with high display quality and further reduction in power consumption at the same time.

Second Embodiment

Figure 19A:
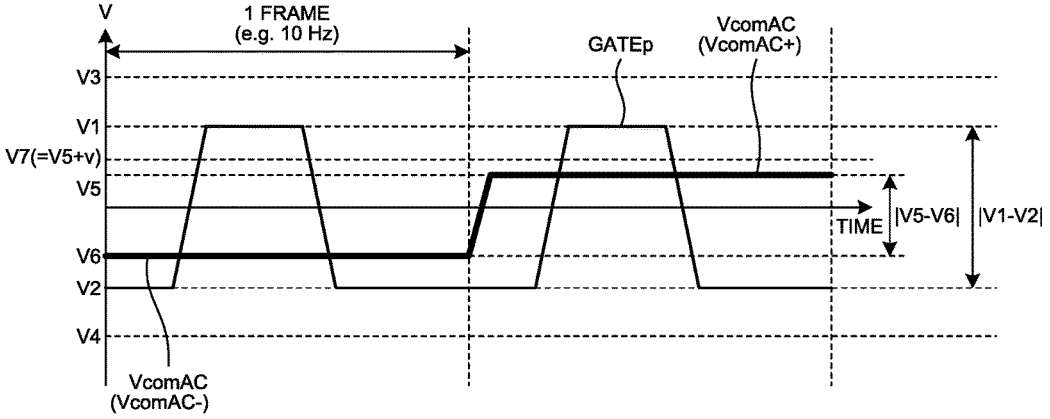
FIGS. 19A to 19C are diagrams each illustrating a waveform example of the frame inversion driving method different from those in FIGS. 6A to 6C.
Figure 19B:
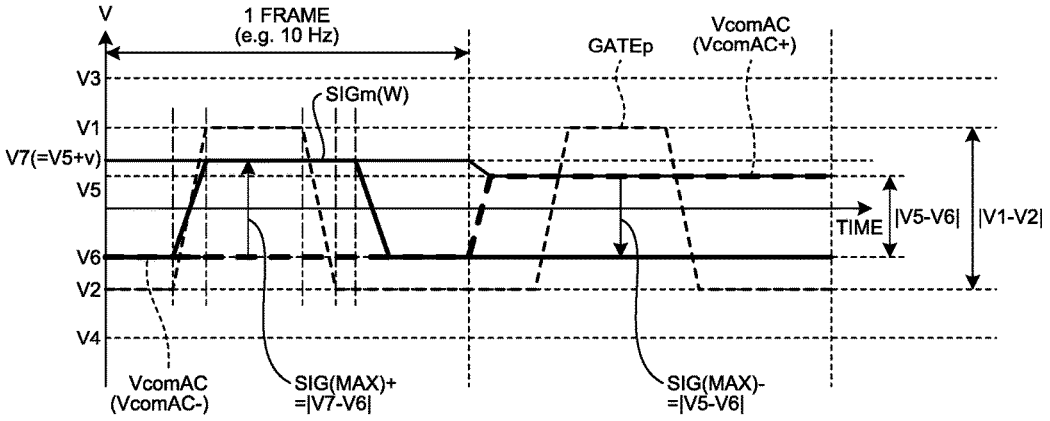
Figure 19C:
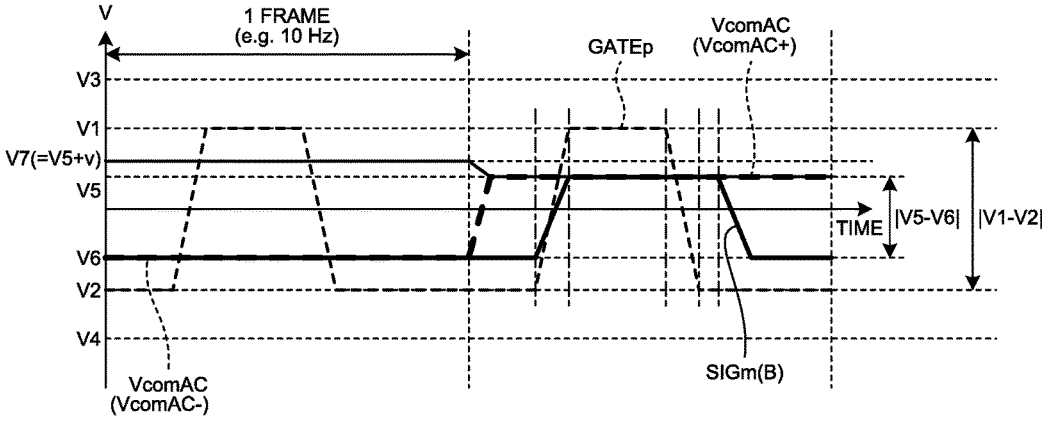

FIGS. 19A to 19C are diagrams illustrating waveform examples of the frame inversion driving method different from those in FIGS. 6A to 6C. A configuration of the display device according to a second embodiment and a schematic configuration of a display system to which the display device according to the second embodiment is applied are the same as those in the first embodiment, so that duplicated descriptions will be omitted. Also in the example illustrated in FIGS. 19A to 19C, similarly to FIGS. 6A to 6C in the first embodiment, waveform examples are illustrated in the case in which the image display panel 10 is a normally black type liquid crystal display panel.

In the example of the first embodiment illustrated in FIGS. 6A to 6C, the voltage difference SIG(MAX)+ between the negative polarity voltage VcomAC− of the AC common voltage VcomAC and the video signal SIGm(W) for obtaining the maximum luminance is equal to the voltage difference SIG(MAX)− between the positive polarity voltage VcomAC+ of the AC common voltage VcomAC and the video signal SIGm(W) for obtaining the maximum luminance ((SIG(MAX)+)=(SIG(MAX)−)=|V5−V6|). However, due to characteristics of the pixel transistor TR, the voltage difference with respect to the video signal SIGm(W) for obtaining the same maximum luminance is typically different between a case in which the AC common voltage VcomAC is the negative polarity voltage VcomAC− and a case in which the AC common voltage VcomAC is the positive polarity voltage VcomAC+. Thus, as illustrated in FIGS. 6A to 6C, by causing the voltage difference SIG (MAX)+ between the negative polarity voltage VcomAC− of the AC common voltage VcomAC and the video signal SIGm(W) for obtaining the maximum luminance to be different from the voltage difference SIG(MAX)− between the positive polarity voltage VcomAC+ of the AC common voltage VcomAC and the video signal SIGm(W) for obtaining the maximum luminance, a luminance difference between frames can be reduced. Specifically, at a low frame rate, the luminance difference for each frame is hardly visually recognized as flicker.

Thus, in the present embodiment, as illustrated in FIGS. 19A to 19C, the voltage difference SIG(MAX)+(=|V7−V6|) between the negative polarity voltage VcomAC− of the AC common voltage VcomAC and the video signal SIGm(W) for obtaining the maximum luminance is caused to be different from the voltage difference SIG(MAX)−(=|V5−V6|) between the positive polarity voltage VcomAC+ of the AC common voltage VcomAC and the video signal SIGm (W) for obtaining the maximum luminance so that the maximum luminance in a case in which the AC common voltage VcomAC is the negative polarity voltage VcomAC− is substantially identical to the maximum luminance in a case in which the AC common voltage VcomAC is the positive polarity voltage VcomAC+.

More specifically, the voltage difference SIG(MAX)+ (=|V7−V6|) between the negative polarity voltage VcomAC− of the AC common voltage VcomAC and the video signal SIGm(W) for obtaining the maximum luminance is caused to be larger than the voltage difference SIG(MAX)− (=|V5−V6|) between the positive polarity voltage VcomAC+ of the AC common voltage VcomAC and the video signal SIGm(W) for obtaining the maximum luminance. That is, the voltage V7 for obtaining the maximum luminance in a case in which the AC common voltage VcomAC is the negative polarity voltage VcomAC− is assumed to be a value obtained by adding a voltage v to the positive polarity voltage VcomAC+(V5) of the AC common voltage VcomAC (i.e., V7=V5+v). The voltage v is a voltage difference between SIG(MAX)+(=|V7−V6|) and SIG (MAX)−(=|V5−V6|) (i.e., v=(SIG(MAX)+)−(SIG (MAX)−)) required for causing the maximum luminance, in a case in which the AC common voltage VcomAC is the negative polarity voltage VcomAC−, to be substantially identical to the maximum luminance in a case in which the AC common voltage VcomAC is the positive polarity voltage VcomAC+.

Accordingly, the luminance difference between the frames can be reduced, and prevented from being visually recognized as flicker.

As described above, the present embodiment also describes a case in which the image display panel 10 is a normally black type liquid crystal display panel. The present embodiment is similar to the first embodiment in that when the pixel PX is displayed with the maximum luminance in the second display mode, the pixel cannot be rewritten in some cases after the frame in which the AC common voltage VcomAC has the negative polarity (VcomAC−) is shifted to the frame in which the AC common voltage VcomAC has the positive polarity (VcomAC+), and the electric charge of the pixel capacitor CS of the pixel PX leaks and the pixel PX cannot be kept with the maximum luminance in some cases when the frame in which the AC common voltage VcomAC has the positive polarity (VcomAC+) is shifted to the frame in which the AC common voltage VcomAC has the negative polarity (VcomAC−).

Figure 20:
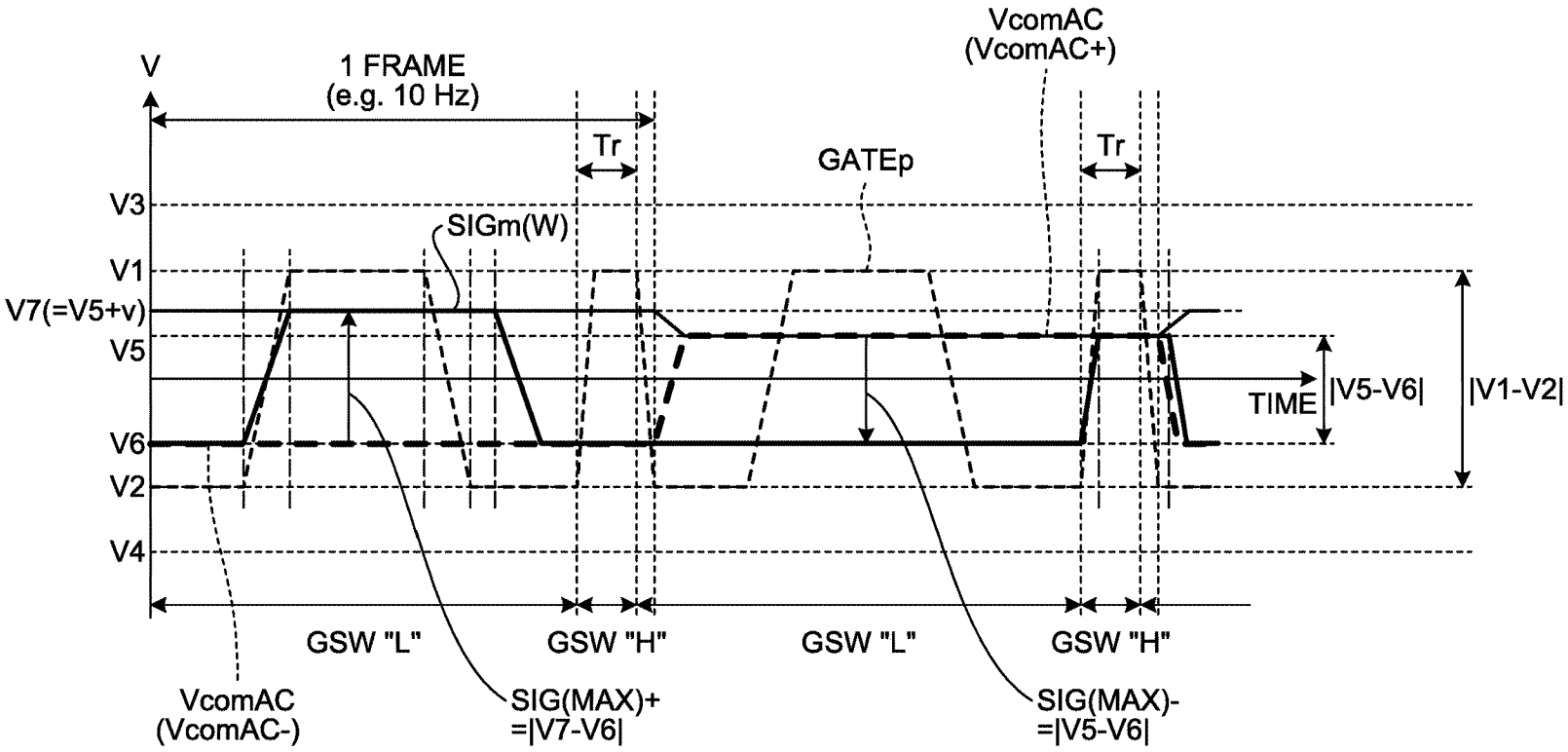
FIG. 20 is a diagram illustrating a waveform example of the frame inversion driving method according to a second embodiment.

FIG. 20 is a diagram illustrating a waveform example of the frame inversion driving method according to the second embodiment. An internal configuration of the gate drive circuit for implementing the frame inversion driving method according to the second embodiment and an operation example thereof are the same as those in FIGS. 9A to 9C in the first embodiment, so that duplicated descriptions will be omitted.

FIG. 20 exemplifies waveforms of the gate signal (scanning signal) GATEp in the pixel PX in the m-th column and the p-th row, the AC common voltage VcomAC, the source signal (video signal) SIG(W) (in this case, SIGm(W)) in a case of displaying the pixel PX with the maximum luminance, and the source signal (video signal) SIG(MAX) as a maximum value of the source signal (video signal) SIG for generating the source signal (video signal) SIG(W) (in this case, SIGm(W)).

As illustrated in FIG. 20, in the frame inversion driving method according to the second embodiment, similarly to the first embodiment, the electric charge resetting period Tr is provided for shifting the gate signal (scanning signal) GATEp from V2 [V] (for example, about −5 [V]) to V1 [V] (for example, about +5 [V]) after writing is performed on the pixel PX in the previous frame and before the AC common voltage VcomAC is inverted, to discharge the electric charge of the pixel capacitor CS of the pixel PX. Specifically, similarly to the first embodiment, in the electric charge resetting period Tr after writing is performed on the pixel PX in the previous frame and before the AC common voltage VcomAC is inverted, the gate switching signal GSW is set to be "H" (refer to FIG. 9C), and the gate positive voltage GVDD+ is supplied to all the gate bus lines (scanning lines) SCL. Similarly to the first embodiment, in a period other than the electric charge resetting period Tr, the gate switching signal GSW is set to be "L" (refer to FIG. 9B). Also in this embodiment, the electric charge resetting period Tr is provided in the vertical blanking period in which writing is not performed on the pixel PX.

In this way, similarly to the first embodiment, in the second display mode, by providing the electric charge resetting period Tr in the vertical blanking period in which writing is not performed on the pixel PX before the polarity of the AC common voltage VcomAC is inverted after writing is performed on the pixel PX in the previous frame, it is possible to normally rewrite the pixel PX after the frame in which the AC common voltage VcomAC has the negative polarity (VcomAC−) is shifted to the frame in which the AC common voltage VcomAC has the positive polarity (VcomAC+), when displaying the pixel PX with the maximum luminance in the second display mode in a case in which the image display panel 10 is a normally black type liquid crystal display panel.

Naturally, the first modification and the second modification of the first embodiment can be applied to the present embodiment similarly to the first embodiment. A case of combining the first modification and the second modification of the first embodiment and a case in which the image display panel 10 is a normally white type liquid crystal display panel are also similar to the first embodiment.

Next, the following describes a configuration that can implement the function of preventing flicker as described above with reference to FIG. 21. FIG. 21 is a diagram illustrating an example of an internal block configuration of the signal output circuit of the display device according to the second embodiment.

As illustrated in FIG. 21, a signal output circuit 21*a* of a display device 100*a* according to the present embodiment includes the timing controller 110, a voltage controller 120*a*, and the signal controller 130.

The voltage controller 120*a* includes a positive polarity step-down circuit 123*a* in place of the positive polarity step-down circuit 123 described in the first embodiment. The positive polarity step-down circuit 123*a* steps down the analog positive voltage AVDD+(first voltage V1) and generates the positive polarity voltage VcomAC+(fifth voltage V5) of the AC common voltage VcomAC in the second display mode, generates the seventh voltage V7 obtained by adding, to the positive polarity voltage VcomAC+(V5) of the AC common voltage VcomAC, the voltage v required for causing the maximum luminance, in a case in which the AC common voltage VcomAC is the negative polarity voltage VcomAC−, to be substantially identical to the maximum luminance in a case in which the AC common voltage VcomAC is the positive polarity voltage VcomAC+, and switches between the fifth voltage V5 and the seventh voltage V7 in accordance with the second timing pulse Tpulse2.

Figure 22:
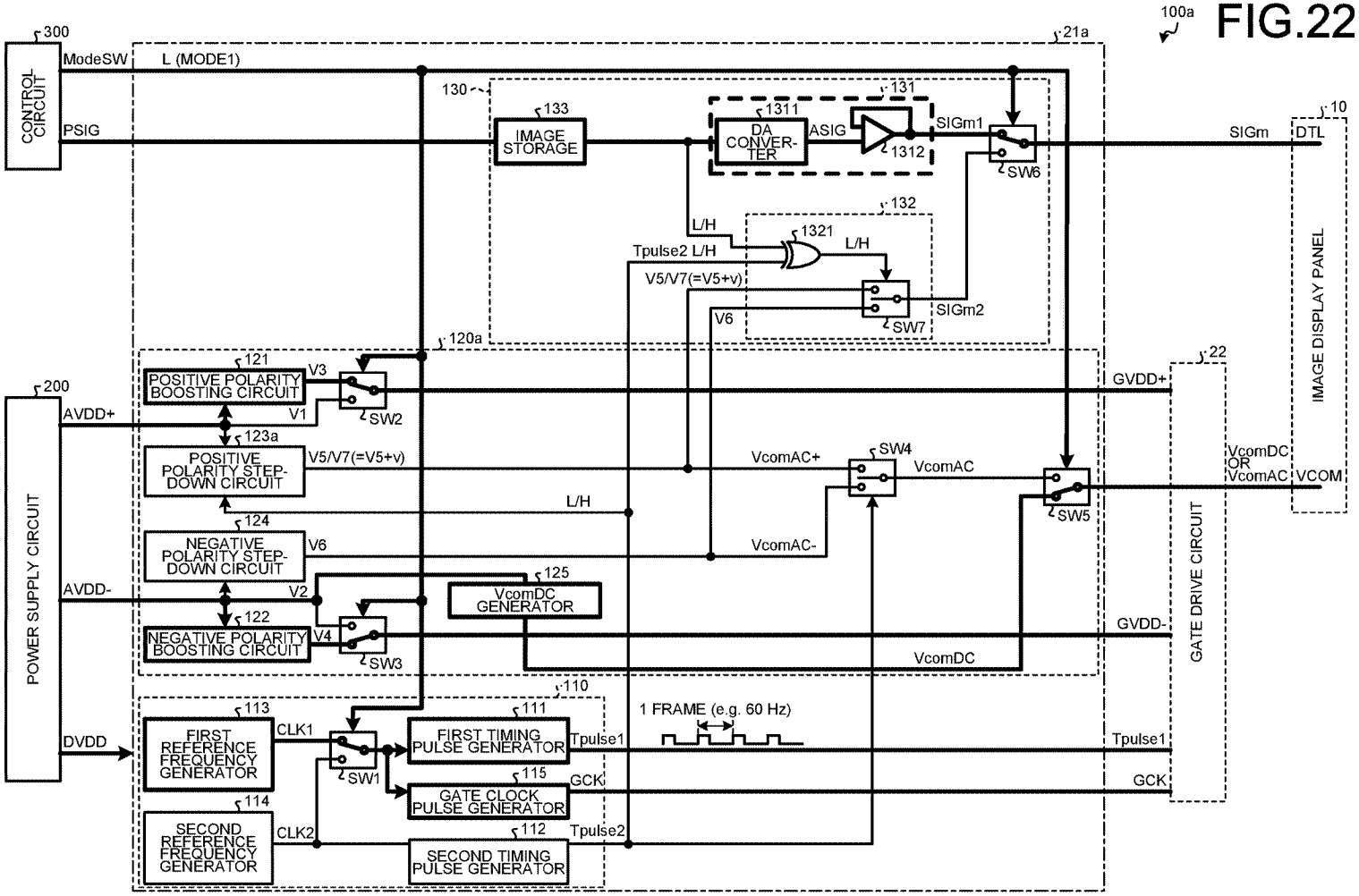
FIG. 22 is a diagram illustrating an operation example in a first display mode according to the second embodiment.
Figure 24:
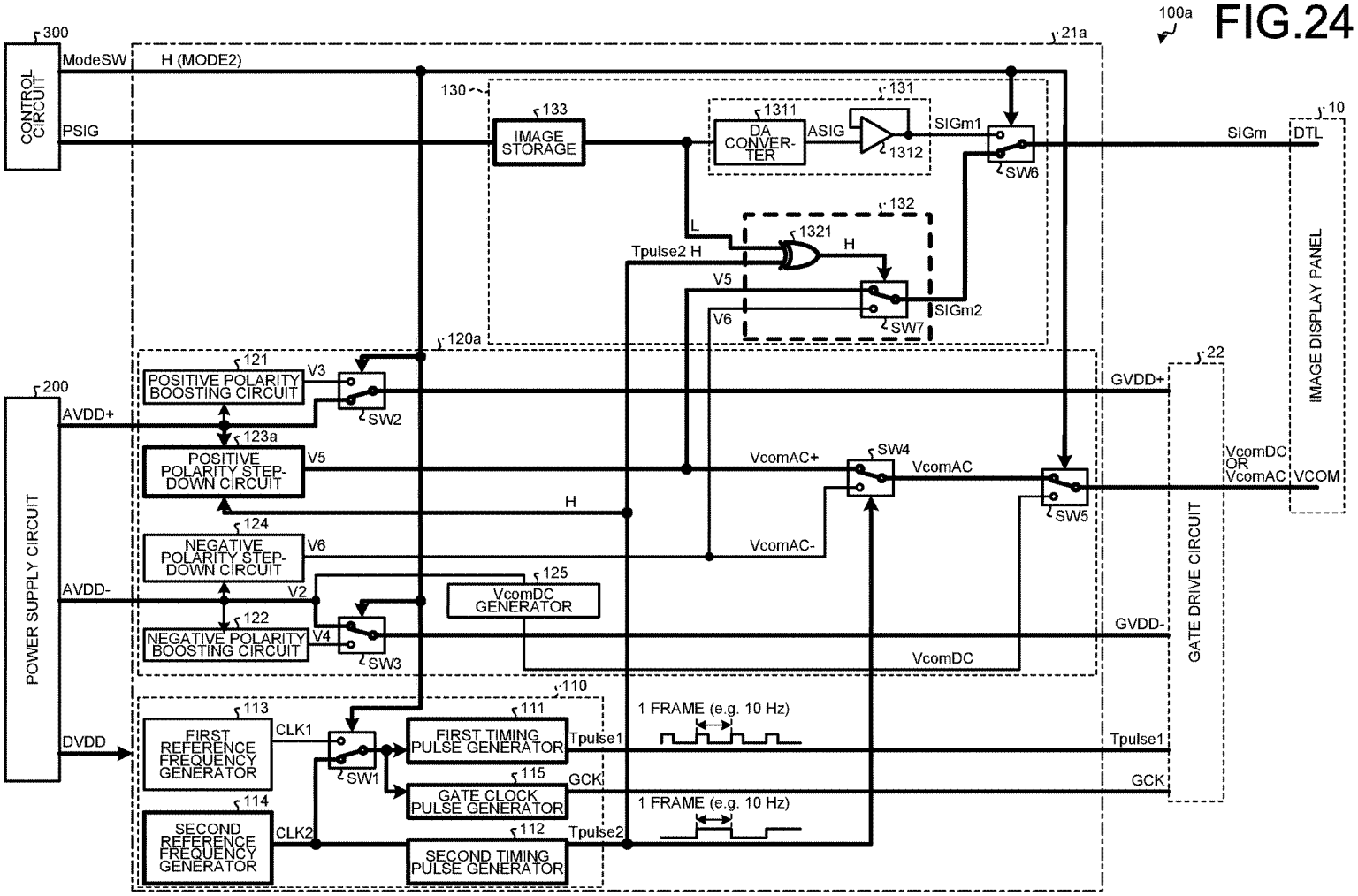
FIG. 24 is a diagram illustrating a second operation example in the second display mode according to the second embodiment.
Figure 25:
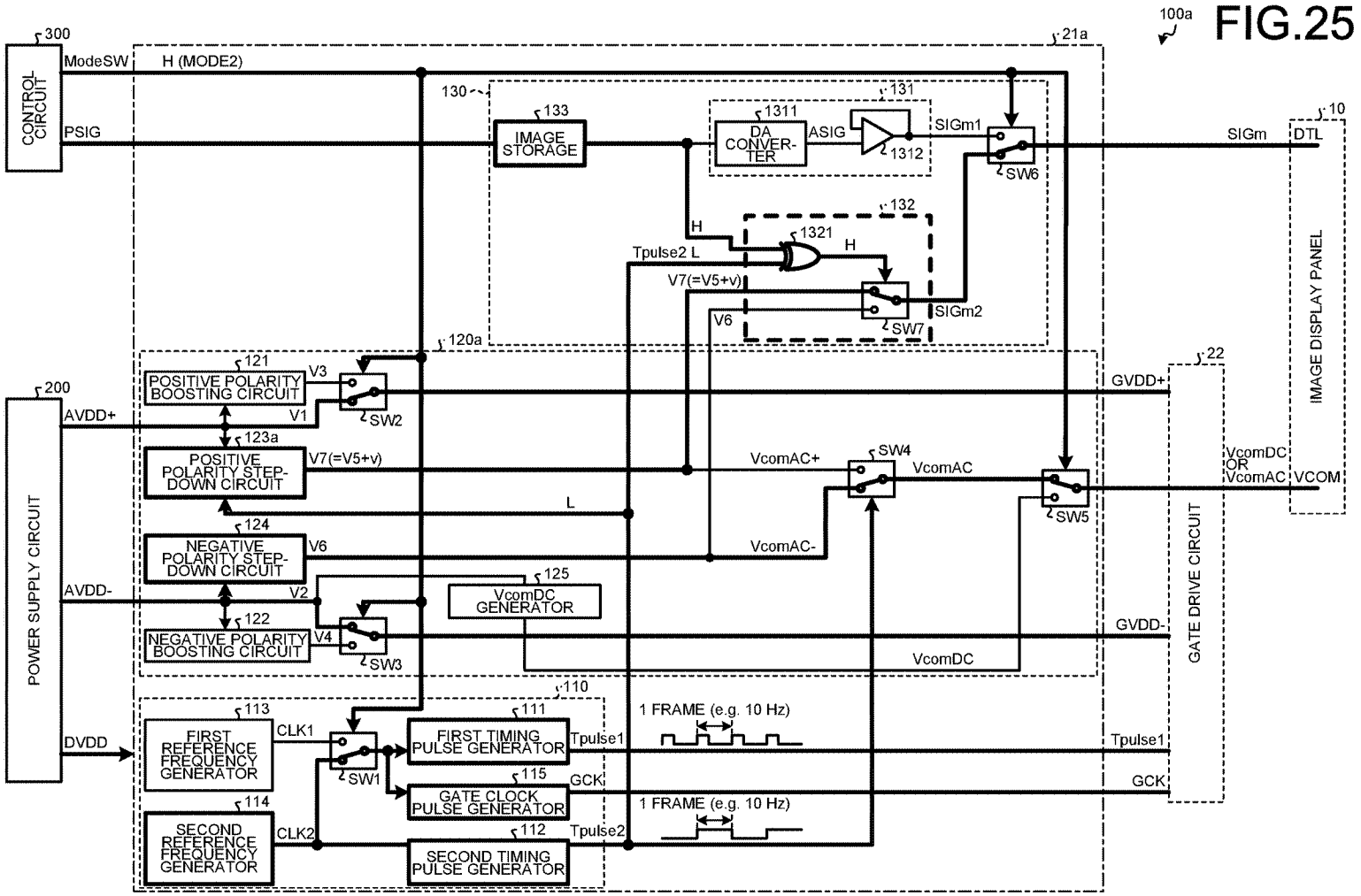
FIG. 25 is a diagram illustrating a third operation example in the second display mode according to the second embodiment.
Figure 26:
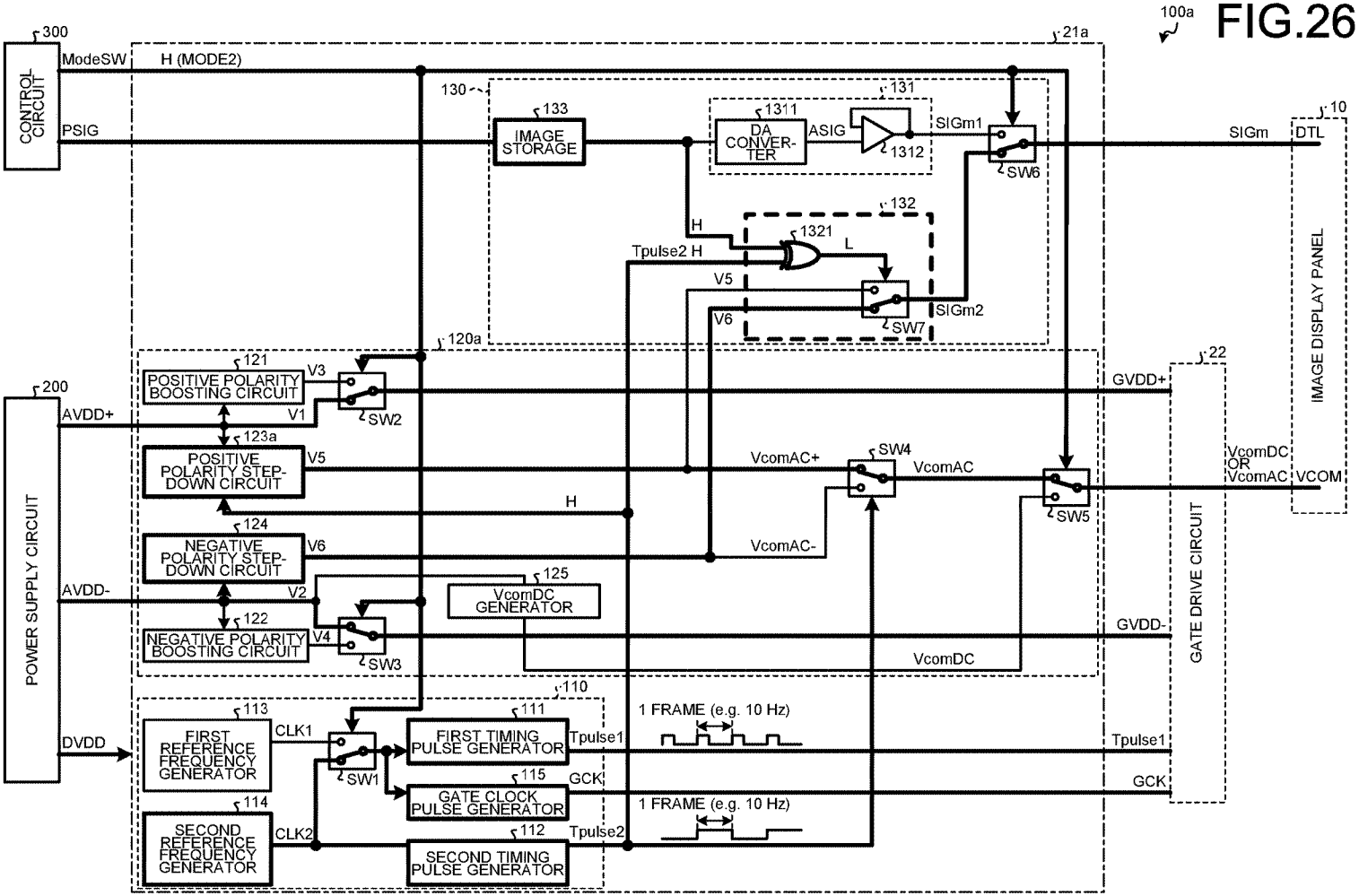
FIG. 26 is a diagram illustrating a fourth operation example in the second display mode according to the second embodiment.

Next, the following describes an operation of the signal output circuit 21*a* configured as described above with reference to FIGS. 22 to 26. FIG. 22 is a diagram illustrating an operation example in the first display mode according to the second embodiment. FIG. 23 is a diagram illustrating a first operation example in the second display mode according to the second embodiment. FIG. 24 is a diagram illustrating a second operation example in the second display mode according to the second embodiment. FIG. 25 is a diagram illustrating a third operation example in the second display mode according to the second embodiment. FIG. 26 is a diagram illustrating a fourth operation example in the second display mode according to the second embodiment. FIG. 23 illustrates an operation example in a case in which the input video signal PSIG is "L", i.e., display is performed with the minimum luminance (black) in the second display mode, and the second timing pulse Tpulse2 is "L", i.e., the AC common voltage VcomAC is the negative polarity voltage VcomAC−. FIG. 24 illustrates an operation example in a case in which the input video signal PSIG is "L", i.e., display is performed with the minimum luminance (black) in the second display mode, and the second timing pulse Tpulse2 is "H", i.e., the AC common voltage VcomAC is the negative polarity voltage VcomAC+. FIG. 25 illustrates an operation example in a case in which the input video signal PSIG is "H", i.e., display is performed with the maximum luminance in the second display mode, and the second timing pulse Tpulse2 is "L", i.e., the AC common voltage VcomAC is the negative polarity voltage VcomAC−. FIG. 26 illustrates an operation example in a case in which the input video signal PSIG is "H", i.e., display is performed with the maximum luminance in the second display mode, and the second timing pulse Tpulse2 is "H", i.e., the AC common voltage VcomAC is the negative polarity voltage VcomAC+.

An operation in the first display mode is the same as that in the first embodiment, so that the description thereof will not be repeated. The following describes an operation in the second display mode. In the examples illustrated in FIGS. 23 to 26, the mode switching signal ModeSW output from the control circuit 300 serving as the host processor of the electronic apparatus, for example, is "H (MODE2)" in the second display mode.

When the second timing pulse Tpulse2 is "H", i.e., when the AC common voltage VcomAC is the positive polarity voltage VcomAC+(refer to FIGS. 24 and 26), the positive polarity step-down circuit 123*a* steps down the analog positive voltage AVDD+(first voltage V1) and generates the fifth voltage V5.

In the examples illustrated in FIG. 24 and FIG. 26, the second timing pulse Tpulse2 is "H", so that the positive polarity voltage VcomAC+(fifth voltage V5) of the AC common voltage VcomAC is selected by the fourth switch SW4. Based on the mode switching signal ModeSW "H (MODE2)", the AC common voltage VcomAC (in this case, VcomAC+) is selected by the fifth switch SW5 to be output to the image display panel 10.

In the example illustrated in FIG. 24, the input video signal PSIG is "L" and the second timing pulse Tpulse2 is "H", so that the output from the exclusive OR computing element 1321 becomes "H", and the fifth voltage V5 is selected by the seventh switch SW7 as the source signal (video signal) SIG (in this case, SIGm2) in the second display mode. Based on the mode switching signal ModeSW "H (MODE2)", the source signal (video signal) SIGm2 selected by the seventh switch SW7 is selected by the sixth switch SW6 to be output as the source signal (video signal) SIGm to the image display panel 10.

In the example illustrated in FIG. 26, the input video signal PSIG is "H" and the second timing pulse Tpulse2 is "H", so that the output from the exclusive OR computing element 1321 becomes "L", and the sixth voltage V6 is selected by the seventh switch SW7 as the source signal (video signal) SIG (in this case, SIGm2) in the second display mode. Based on the mode switching signal ModeSW "H (MODE2)", the source signal (video signal) SIGm2 selected by the seventh switch SW7 is selected by the sixth switch SW6 to be output as the source signal (video signal) SIGm to the image display panel 10.

When the second timing pulse Tpulse2 is "L", i.e., when the AC common voltage VcomAC is the negative polarity voltage VcomAC− (refer to FIGS. 23 and 25), the positive polarity step-down circuit 123*a* steps down the analog positive voltage AVDD+(first voltage V1) and generates the seventh voltage V7. In this case, the seventh voltage V7 is a value obtained by adding the voltage v described above to the fifth voltage V5 (V7=V5+v).

In the examples illustrated in FIGS. 23 and 25, the second timing pulse Tpulse2 is "L", so that the negative polarity voltage VcomAC− (sixth voltage V6) of the AC common voltage VcomAC is selected by the fourth switch SW4. Based on the mode switching signal ModeSW "H (MODE2)", the AC common voltage VcomAC (in this case, VcomAC−) is selected by the fifth switch SW5 to be output to the image display panel 10.

In the example illustrated in FIG. 23, the input video signal PSIG is "L" and the second timing pulse Tpulse2 is "L", so that the output from the exclusive OR computing element 1321 becomes "L", and the sixth voltage V6 is selected by the seventh switch SW7 as the source signal (video signal) SIG (in this case, SIGm2) in the second display mode. Based on the mode switching signal ModeSW "H (MODE2)", the source signal (video signal) SIGm2 selected by the seventh switch SW7 is selected by the sixth switch SW6 to be output as the source signal (video signal) SIGm to the image display panel 10.

In the example illustrated in FIG. 25, the input video signal PSIG is "H" and the second timing pulse Tpulse2 is "L", so that the output from the exclusive OR computing element 1321 becomes "H", and the seventh voltage V7 is selected by the seventh switch SW7 as the source signal (video signal) SIG (in this case, SIGm2) in the second display mode. Based on the mode switching signal ModeSW "H (MODE2)", the source signal (video signal) SIGm2 selected by the seventh switch SW7 is selected by the sixth switch SW6 to be output as the source signal (video signal) SIGm to the image display panel 10.

As described above, as illustrated in FIG. 26, when the input video signal PSIG is "H" and the second timing pulse Tpulse2 is "H", i.e., when the AC common voltage VcomAC is the positive polarity voltage VcomAC+ and display is performed with the maximum luminance, the output from the exclusive OR computing element 1321 becomes "L", and the voltage difference SIG(MAX)− between the positive polarity voltage VcomAC+ of the AC common voltage VcomAC and the video signal SIGm(W) for obtaining the maximum luminance becomes a difference value between the fifth voltage V5 and the sixth voltage V6 (i.e., (SIG(MAX)−)=|V5−V6|) as illustrated in FIG. 19B. As illustrated in FIG. 25, when the input video signal PSIG is "H" and the second timing pulse Tpulse2 is "L", i.e., when the AC common voltage VcomAC is the negative polarity voltage VcomAC− and display is performed with the maximum luminance, the output from the exclusive OR computing element 1321 becomes "H", and the voltage difference SIG(MAX)+ between the negative polarity voltage VcomAC− of the AC common voltage VcomAC and the video signal SIGm(W) for obtaining the maximum luminance becomes a difference value between the seventh voltage V7 and the sixth voltage V6 (i.e., (SIG(MAX)+)=|V7−V6|) as illustrated in FIG. 19B.

When the AC common voltage VcomAC is the negative polarity voltage VcomAC−, SIG(MAX)+ is the voltage difference between the negative polarity voltage VcomAC− of the AC common voltage VcomAC and the video signal SIGm(W) for obtaining the maximum luminance. When the AC common voltage VcomAC is the positive polarity voltage VcomAC+, SIG(MAX)− is the voltage difference between the positive polarity voltage VcomAC+ of the AC common voltage VcomAC and the video signal SIGm(W) for obtaining the maximum luminance. Through the operation described above, the difference value between SIG(MAX)+ and SIG(MAX)− becomes the voltage v (i.e., (SIG(MAX)+)−(SIG(MAX)−)=v), so that the maximum luminance in a case in which the AC common voltage VcomAC is the negative polarity voltage VcomAC− can be caused to be substantially identical to the maximum luminance in a case in which the AC common voltage VcomAC is the positive polarity voltage VcomAC+.

As described above, in the display device 100*a* according to the second embodiment, the voltage difference between the negative polarity voltage of the common voltage and the video signal for obtaining the maximum luminance is caused to be different from the voltage difference between the positive polarity voltage of the common voltage and the video signal for obtaining the maximum luminance so that the maximum luminance in a case in which the common voltage has the negative polarity is substantially identical to the maximum luminance in a case in which the common voltage has the positive polarity in the second display mode.

More specifically, the video signal for obtaining the maximum luminance when the common voltage has the negative polarity is assumed to have a value obtained by adding, to the positive polarity voltage of the common voltage, the voltage required for causing the maximum luminance, in a case in which the common voltage has the negative polarity, to be substantially identical to the maximum luminance in a case in which the common voltage has the positive polarity.

Accordingly, the luminance difference between the frames in the second display mode can be reduced so as to prevent flicker from being visually recognized.

The components in the embodiments described above can be appropriately combined with each other. The present invention naturally encompasses other function effects caused by the aspects described in the above embodiments that are obvious from the description herein or that are appropriately conceivable by those skilled in the art.

What is claimed is:

1. A display device comprising:

an image display panel including a plurality of pixels, a plurality of scanning lines, each of which is coupled to the pixels arranged in a first direction, and to which a scanning signal is supplied, a plurality of video signal lines, each of which is coupled to the pixels arranged in a second direction intersecting the first direction, and to which a video signal is supplied, and a common electrode that is coupled to the pixels, and to which a common voltage is applied; and a driver configured to drive the image display panel, wherein the driver is configured to implement a first display mode in which the common voltage is a constant DC voltage; polarity of the video signal is inverted per a predetermined number of the video signal lines; and the polarity of the video signal per a predetermined number of the video signal lines is inverted in a frame unit, and a second display mode in which the common voltage is an AC voltage, polarity of which is inverted in a frame unit; the polarity of the video signal is opposite to the polarity of the common voltage; and the polarity of the video signal is inverted to be opposite to the polarity of the common voltage in a frame unit, and the driver is configured to switch between the first display mode and the second display mode in accordance with a mode switching signal supplied from the outside.

2. The display device according to claim 1, wherein the driver is supplied with a first voltage having positive polarity and a second voltage having negative polarity, the driver includes a positive polarity boosting circuit configured to boost the first voltage and generate a third voltage, and a negative polarity boosting circuit configured to boost the second voltage and generate a fourth voltage, the driver is configured to cause the positive polarity boosting circuit and the negative polarity boosting circuit to operate in the first display mode to cause the third voltage to be a high potential side voltage of the scanning signal, and to cause the fourth voltage to be a low potential side voltage of the scanning signal, and the driver is configured to cause the positive polarity boosting circuit and the negative polarity boosting circuit to stop in the second display mode to cause the first voltage to be the high potential side voltage of the scanning signal, and to cause the second voltage to be the low potential side voltage of the scanning signal.

3. The display device according to claim 2, wherein the driver further includes a positive polarity step-down circuit configured to step down the first voltage and generate a fifth voltage, and a negative polarity step-down circuit configured to step down the second voltage and generate a sixth voltage, and the driver is configured to switch between the fifth voltage and the sixth voltage in a frame unit in the second display mode to generate the common voltage.

4. The display device according to claim 1, wherein the driver further includes a DA converter configured to convert a binary input signal into a multi-gradation signal, the driver is configured to cause the DA converter to operate in the first display mode to generate the video signal, and the driver is configured to cause the DA converter to stop in the second display mode and cause the binary input signal to be inverted in accordance with the polarity of the common voltage to generate the video signal.

5. The display device according to claim 1, wherein the driver is configured to drive the image display panel in the second display mode at a frame rate lower than that in the first display mode.

6. The display device according to claim 1, wherein, in the second display mode, the driver is configured to cause a voltage difference between the common voltage in a case in which the common voltage has negative polarity and the video signal for obtaining maximum luminance to be different from a voltage difference between the common voltage in a case in which the common voltage has positive polarity and the video signal for obtaining the maximum luminance.

7. The display device according to claim 1, wherein an electric charge resetting period in which an electric charge of a pixel capacitor of each of the pixels is discharged in a frame unit is provided in the second display mode.

8. The display device according to claim 7, wherein the electric charge resetting period is provided in a vertical blanking period in which writing is not performed on the pixels before the polarity of the common voltage is inverted.

9. The display device according to claim 7, wherein image display is performed in any of a plurality of regions obtained by dividing a display region of the image display panel in a scanning direction in the second display mode.

10. The display device according to claim 7, wherein a writing period for performing writing on the pixels within one frame period in a region in which image display is performed is equal to or shorter than 10 [ms] in the second display mode.

11. A control method for controlling an image display panel, the image display panel including: a plurality of pixels; a plurality of scanning lines, each of which is coupled to the pixels arranged in a first direction, and to which a scanning signal is supplied; a plurality of video signal lines, each of which is coupled to the pixels arranged in a second direction intersecting the first direction, and to which a video signal is supplied; and a common electrode that is coupled to the pixels, and to which a common voltage is applied, the control method comprising:

implementing a first display mode and a second display mode each having a different driving method for driving the image display panel;

in the first display mode, causing the common voltage to be a constant DC voltage, inverting polarity of the video signal per a predetermined number of the video signal lines, and inverting the polarity of the video signal per a predetermined number of the video signal lines in a frame unit;

in the second display mode, causing the common voltage to be an AC voltage, polarity of which is inverted in a frame unit, making the polarity of the video signal opposite to the polarity of the common voltage, and inverting the polarity of the video signal to be opposite to the polarity of the common voltage in a frame unit;

switching the second display mode to the first display mode in accordance with a first switching signal supplied from the outside; and switching the first display mode to the second display mode in accordance with a second switching signal supplied from the outside.

12. A semiconductor device for driving an image display panel, the image display panel comprising:

a plurality of pixels;

a plurality of scanning lines, each of which is coupled to the pixels arranged in a first direction, and to which a scanning signal is supplied;

a plurality of video signal lines, each of which is coupled to the pixels arranged in a second direction intersecting the first direction, and to which a video signal is supplied; and a common electrode that is coupled to the pixels, and to which a common voltage is applied, wherein the semiconductor device implements a first display mode in which the common voltage is a constant DC voltage; polarity of the video signal is inverted per a predetermined number of the video signal lines; and the polarity of the video signal per a predetermined number of the video signal lines is inverted in a frame unit, and a second display mode in which the common voltage is an AC voltage, polarity of which is inverted in a frame unit; the polarity of the video signal is opposite to the polarity of the common voltage; and the polarity of the video signal is inverted to be opposite to the polarity of the common voltage in a frame unit, and the first display mode and the second display mode can be switched in accordance with a mode switching signal from the outside.

* * * * *